US010919325B2

(12) United States Patent
Kondo

(10) Patent No.: US 10,919,325 B2
(45) Date of Patent: Feb. 16, 2021

(54) CUTTING APPARATUS AND PRINTING APPARATUS

(71) Applicant: BROTHER KOGYO KABUSHIKI KAISHA, Nagoya (JP)

(72) Inventor: Hidenobu Kondo, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/714,682

(22) Filed: Dec. 13, 2019

(65) Prior Publication Data

US 2020/0198378 A1 Jun. 25, 2020

(30) Foreign Application Priority Data

Dec. 25, 2018 (JP) ..... 2018-240789

(51) Int. Cl.
*B41J 11/66* (2006.01)

(52) U.S. Cl.
CPC ..... *B41J 11/663* (2013.01)

(58) Field of Classification Search
CPC ..... B41J 11/663; B41J 11/666; B41J 11/70; B41J 11/703
See application file for complete search history.

(56) References Cited

U.S. PATENT DOCUMENTS

| | | | | |
|---|---|---|---|---|
| 5,957,597 | A | 9/1999 | Kato | |
| 8,789,909 | B2 * | 7/2014 | Shimizu | B41J 11/663 347/16 |
| 2015/0084262 | A1 | 3/2015 | Sago et al. | |

FOREIGN PATENT DOCUMENTS

| | | | |
|---|---|---|---|
| JP | 3-223058 | A | 10/1991 |
| JP | 11-170638 | A | 6/1999 |
| JP | 2001-088380 | A | 4/2001 |
| JP | 2003-127483 | A | 5/2003 |
| JP | 2005-271112 | A | 10/2005 |
| JP | 2008-080448 | A | 4/2008 |
| JP | 2008-080449 | A | 4/2008 |
| JP | 2015-85507 | A | 5/2015 |

* cited by examiner

*Primary Examiner* — Thinh H Nguyen
(74) *Attorney, Agent, or Firm* — Kenealy Vaidya LLP

(57) ABSTRACT

In a cutting apparatus, a controller is configured to: start energization of an actuator to move a cutter relative to a receiving stage from a wait position toward a cutting position; determine whether a position detector has detected that the cutter has reached the cutting position; when the position detector does not detect that the cutter has reached the cutting position, determine whether a value of a current detected by a current detector has reached a first set value; when the value of the current detected by the current detector has reached the first set value, change a current to be passed through the actuator to a second set value that is less than the first set value; and when the position detector has detected that the cutter has reached the cutting position, finish the energization of the actuator and stops movement of the cutter relative to the receiving stage.

5 Claims, 13 Drawing Sheets

| SWITCH | FULL CUT | | STANDBY STATE | HALF CUT | |
|---|---|---|---|---|---|
| | FULL-CUT POSITION | FROM SEPARATED POSITION TO FULL-CUT POSITION | STANDBY POSITION/ SEPARATED POSITION | FROM STANDBY POSITION TO CUTTING POSITION | CUTTING POSITION |
| FIRST SWITCH | ON | OFF | OFF | OFF | ON |
| SECOND SWITCH | ON | ON | OFF | OFF | OFF |

FIG.11

| FIRST SET VALUE | | | |
|---|---|---|---|
| WIDTH OF PRINTING MEDIUM | NUMBER OF CUTS N | | |
| | N<n1 | n1≦N<n2 | n2≦N |
| 24mm, 36mm, 51mm | 0. 30A | 0. 38A | 0. 45A |
| 6mm, 9mm, 12mm, 18mm | 0. 20A | 0. 28A | 0. 45A |

631

CUTTING APPARATUS AND PRINTING APPARATUS

CROSS REFERENCE TO RELATED APPLICATION

The present application claims priority from Japanese Patent Application No. 2018-240789, which was filed on Dec. 25, 2018, the disclosure of which is herein incorporated by reference in its entirety.

BACKGROUND

The following disclosure relates to a cutting apparatus configured to cut a medium and to a printing apparatus including the cutting apparatus.

There is known a cutting apparatus for cutting a medium. Cutting of the medium includes: a half cut (also called a partial cut) for partly cutting the medium in its thickness direction; and a full cut for cutting the medium so as to completely separate the medium into two parts.

There is known a tape printing device capable of performing a half cut. The tape printing device includes a half-cut mechanism including a fixed portion and a movable portion, a cutter driving motor, a drive cam, a detection sensor, a conveying mechanism, and a controller. The tape printing device performs the half cut as follows. The controller drives the conveying mechanism to convey the printing medium to a position between a receiving stage of the fixed portion and a cutting blade of the movable portion. When the cutter driving motor is rotated forward by control of the controller, a cam plate of the drive cam is rotated to a first rotational position. The rotation of the cam plate brings the cutting blade of the movable portion close to the receiving stage of the fixed portion. When the cutter driving motor is further rotated forward, the cam plate of the drive cam is rotated to a second rotational position. In this state, a half cut is performed in the printing medium nipped between the cutting blade and the receiving stage. The detection sensor detects a detection plate provided on the cam plate. In the case where the detection plate is detected by the detection sensor, the controller determines that the cam plate of the drive cam has been rotated to the second rotational position, and the half cut is finished. The controller stops the cutter driving motor for a predetermined length of time and then rotates the cutter driving motor reversely. The cam plate of the drive cam is moved back to its original position, and the cutting blade is separated from the receiving stage.

SUMMARY

The timing of detection of the detection sensor in some cases varies due to an error in detection of the detection sensor, an error in dimension of any of the half-cut mechanism and the drive cam, and an error in assembly of components, for example. In this case, there is a possibility that the cutting blade is pressed against the receiving stage by a large force by driving of the cutter driving motor, leading to lower durability of the half-cut mechanism.

Accordingly, an aspect of the disclosure relates to a cutting apparatus capable of maintaining good durability of a half-cut mechanism and to a printing apparatus including the cutting apparatus.

In one aspect of the disclosure, a cutting apparatus includes: a receiving stage configured to support a medium in cutting of the medium; a cutter including: a cutting blade configured to cut the medium in a state in which the medium is located between the cutting blade and the receiving stage; and a contact portion configured to contact the receiving stage, the cutter being movable to (i) a wait position at which the contact portion is spaced apart from the receiving stage and (ii) a cutting position which is nearer to the receiving stage than the wait position and at which the receiving stage and the contact portion are in contact with each other; an actuator configured to be driven by energization and configured to move the cutter relative to the receiving stage between the wait position and the cutting position; a controller configured to control the actuator; a current detector configured to detect a current passed through the actuator; and a position detector configured to detect that the cutter has reached the cutting position. The controller is configured to execute: a first control processing in which the controller starts the energization of the actuator to move the cutter relative to the receiving stage from the wait position toward the cutting position; a first determination processing in which the controller determines whether the position detector has detected that the cutter has reached the cutting position in a process in which the cutter is moved relative to the receiving stage from the wait position toward the cutting position; a second determination processing in which, when the controller determines in the first determination processing that the position detector does not detect that the cutter has reached the cutting position, the controller determines whether a value of the current detected by the current detector has reached a first set value; a change processing in which, when the controller determines in the second determination processing that the value of the current detected by the current detector has reached the first set value, the controller changes a current to be passed through the actuator to a second set value that is less than the first set value; and a second control processing in which, when the controller determines in the first determination processing that the position detector has detected that the cutter has reached the cutting position, the controller finishes the energization of the actuator and stops movement of the cutter relative to the receiving stage.

In another aspect of the disclosure, a printing apparatus includes: a cutting apparatus including (i) a receiving stage configured to support a medium in cutting of the medium, (ii) a cutter including (a) a cutting blade configured to cut the medium in a state in which the medium is located between the cutting blade and the receiving stage and (b) a contact portion configured to contact the receiving stage, the cutter being movable to a wait position at which the contact portion is spaced apart from the receiving stage and a cutting position which is nearer to the receiving stage than the wait position and at which the receiving stage and the contact portion are in contact with each other, (iii) an actuator configured to be driven by energization and configured to move the cutter relative to the receiving stage between the wait position and the cutting position, (iv) a controller configured to control the actuator, (v) a current detector configured to detect a current passed through the actuator, and (vi) a position detector configured to detect that the cutter has reached the cutting position, wherein the controller is configured to execute: a first control processing in which the controller starts the energization of the actuator to move the cutter relative to the receiving stage from the wait position toward the cutting position; a first determination processing in which the controller determines whether the position detector has detected that the cutter has reached the cutting position in a process in which the cutter is moved relative to the receiving stage from the wait position toward the cutting position; a second determination processing in which, when the controller determines in the first determination processing that the position detector does not detect that the cutter has reached the cutting position, the controller determines whether a value of the current detected by the current detector has reached a first set value; a change processing in which, when the controller determines in the second determination processing that the value of the current detected by the current detector has reached the first set value, the controller changes a current to be passed through the actuator to a second set value that is less than the first set value; and a second control processing in which, when the controller determines in the first determination processing that the position detector has detected that the cutter has reached the cutting position, the controller finishes the energization of the actuator and stops movement of the cutter relative to the receiving stage; and a printing device configured to perform printing on the medium.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIG. 11 is a view representing a table 631;

EMBODIMENT

Hereinafter, there will be described a printing apparatus 100 according to one embodiment. The words "RIGHT", "LEFT", "FRONT", "REAR", "UP", and "DOWN" indicated by the arrows in the figures respectively indicate right, left, front, rear, upper, and lower sides of the printing apparatus 100 and a cutting apparatus 1.

Overview of Printing Apparatus 100

Figure 1:
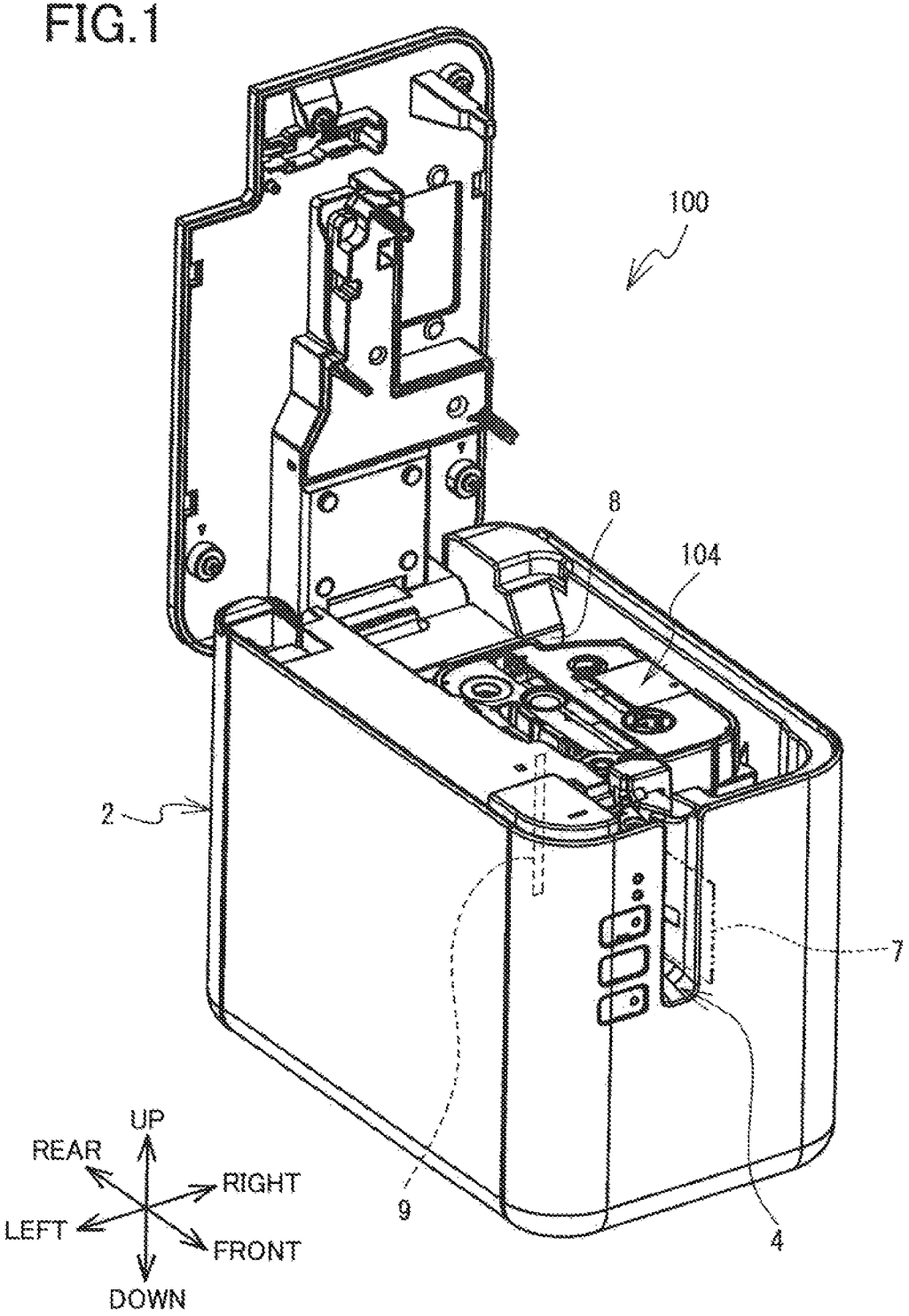
FIG. 1 is a perspective view of a printing apparatus 100.

There will be described a configuration of the printing apparatus 100 with reference to FIGS. 1 and 2. The printing apparatus 100 is configured to perform printing on a printing medium 7 and cut the printing medium 7. In the present embodiment, the printing medium 7 is shaped like an elongated sheet and illustrated only in FIGS. 1 and 2. The printing apparatus 100 includes a main casing 2. The main casing 2 is shaped like a box having a mount portion 8 formed therein. The mount portion 8 is a recessed portion opening upward, and a cassette 104 is mounted in the mount portion 8. The cassette 104 contains a roll of the printing medium 7. There are a plurality of types of the printing media 7 different from each other in width, color, material, or the like. A front wall portion of the main casing 2 has an output opening 4 to which the printing medium 7 is discharged.

Figure 2:
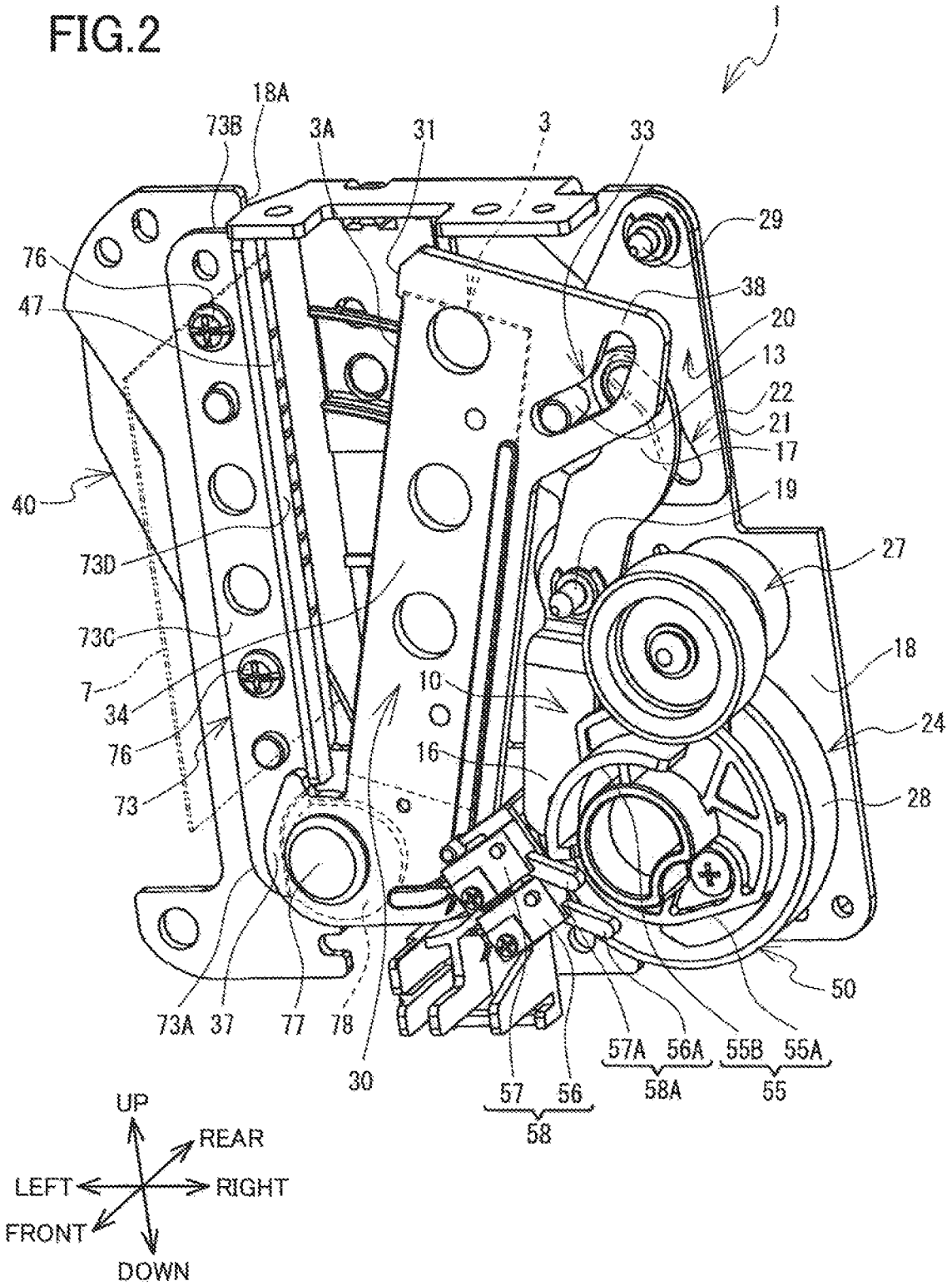
FIG. 2 is a perspective view of a cutter 30 located at a wait position.

The printing apparatus 100 includes a central processing unit (CPU), not illustrated, a plurality of rollers, not illustrated, a thermal head 9, and the cutting apparatus 1 (see FIG. 2). The CPU is capable of identifying the type of the printing medium 7 by detection of the type of the cassette 104 mounted in the mount portion 8. The CPU controls and drives the rollers and the thermal head 9 based on the identified type of the printing medium 7. The rollers controlled by the CPU draw and convey the printing medium 7 contained in the cassette 104, to the output opening 4. A direction (conveying direction) in which the printing medium 7 is conveyed when passing through the output opening 4 is parallel with the front and rear direction. The thermal head 9 controlled by the CPU performs printing on the printing medium 7. Each of the plurality of rollers and the thermal head 9 has a well-known configuration disclosed in Japanese Patent Application Publication No. 11-170638, for example. The cutting apparatus 1 is provided in the main casing 2 behind the output opening 4. The cutting apparatus 1 is capable of cutting the printing medium 7 printed by the thermal head 9.

The printing medium 7 has a well-known configuration constituted by a printing substrate and an adhesive tape by way of example, and illustration of the printing medium 7 is omitted. The printing substrate is a transparent and elongated film tape. One surface of the printing substrate is a printing surface on which the printing apparatus 100 performs printing. The adhesive tape includes: a background substrate; a first adhesive layer applied to a front surface of the background substrate; a second adhesive layer applied to a back surface of the background substrate; and a release paper sheet. The release paper sheet is bonded to the background substrate with the second adhesive layer. The adhesive tape is bonded to a printed surface of the printing substrate having been printed, with the first adhesive layer. Thus, the printing medium 7 has a five-layer structure including the printing substrate, the first adhesive layer, the background substrate, the second adhesive layer, and the release paper sheet. In the present embodiment, the cutting apparatus 1 performs a half cut or a full cut in the printing medium 7. As will be described below in detail, the cutting apparatus 1 nips the printing medium 7 between a receiving plate 73D and a cutting blade 3 to perform the half cut for cutting the printing substrate, the background substrate, and the adhesive layer. In other words, the printing medium 7 other than the release paper sheet is cut in the half cut. The printing apparatus 100 nips the printing medium 7 between a fixed blade 79 and a full-cut blade 40 to perform the full cut for completely cutting the printing medium 7.

Overview of Cutting Apparatus 1

There will be next described a configuration of the cutting apparatus 1 with reference to FIGS. 2-8. As illustrated in FIG. 2, the cutting apparatus 1 includes a flat-plate portion 18. The flat-plate portion 18 has a rectangular shape when viewed from a back side. The flat-plate portion 18 has a medium-passing hole 18A opening in the front and rear direction. The medium-passing hole 18A extends in the up and down direction and disposed next to the output opening 4 (see FIG. 1) in the front and rear direction. The printing medium 7 passes through the medium-passing hole 18A. A guide member 47 extending in the up and down direction is provided in a left open end of the medium-passing hole 18A. A plurality of ribs protruding rightward are arranged on the guide member 47 along the up and down direction. The guide member 47 guides the printing medium 7 being conveyed frontward, toward the output opening 4.

A receiving stage 73 shaped like a plate is secured to the flat-plate portion 18. The receiving stage 73 includes one end 73A, the other end 73B, an extending portion 73C, and the receiving plate 73D. The one end 73A is a lower end of the receiving stage 73 and disposed below the medium-passing hole 18A. The one end 73A includes a protruding portion 78 protruding frontward. A shaft member 77 is secured to the protruding portion 78 at its substantially center in front elevational view. The axial direction of the shaft member 77 coincides with the front and rear direction. The other end 73B is an upper end of the receiving stage 73. The extending portion 73C extends between the one end 73A and the other end 73B. The extending portion 73C is secured to the flat-plate portion 18 by two screws 76 disposed to the left of the medium-passing hole 18A. The receiving plate 73D protrudes frontward from a right end of the extending portion 73C and has a rectangular shape extending in the up and down direction when viewed from a right side. The receiving plate 73D is capable of supporting the printing medium 7 located on an upstream side (i.e., a rear side) of the guide member 47 in the conveying direction.

A motor 5 (see FIG. 8) is secured to the right of the medium-passing hole 18A. FIGS. 2-7 omit illustration of the motor 5. The motor 5 is a DC motor by way of example. The motor 5 is connected to a motor driver 62 (see FIG. 8) and driven by being energized by the motor driver 62. The motor 5 rotates a rotor 50 via a gear train 24 including gears 27, 28. The rotor 50 is disposed to the right of the shaft member 77 and has a round shape when viewed from a front side. The rotor 50 is rotatably supported by a shaft 59 secured to the flat-plate portion 18 (see FIG. 4). The shaft 59 extends frontward, and its rear end portion extends through the flat-plate portion 18 in the front and rear direction to secure the shaft 59. The axial direction of the shaft 59 coincides with the front and rear direction.

Figure 3:
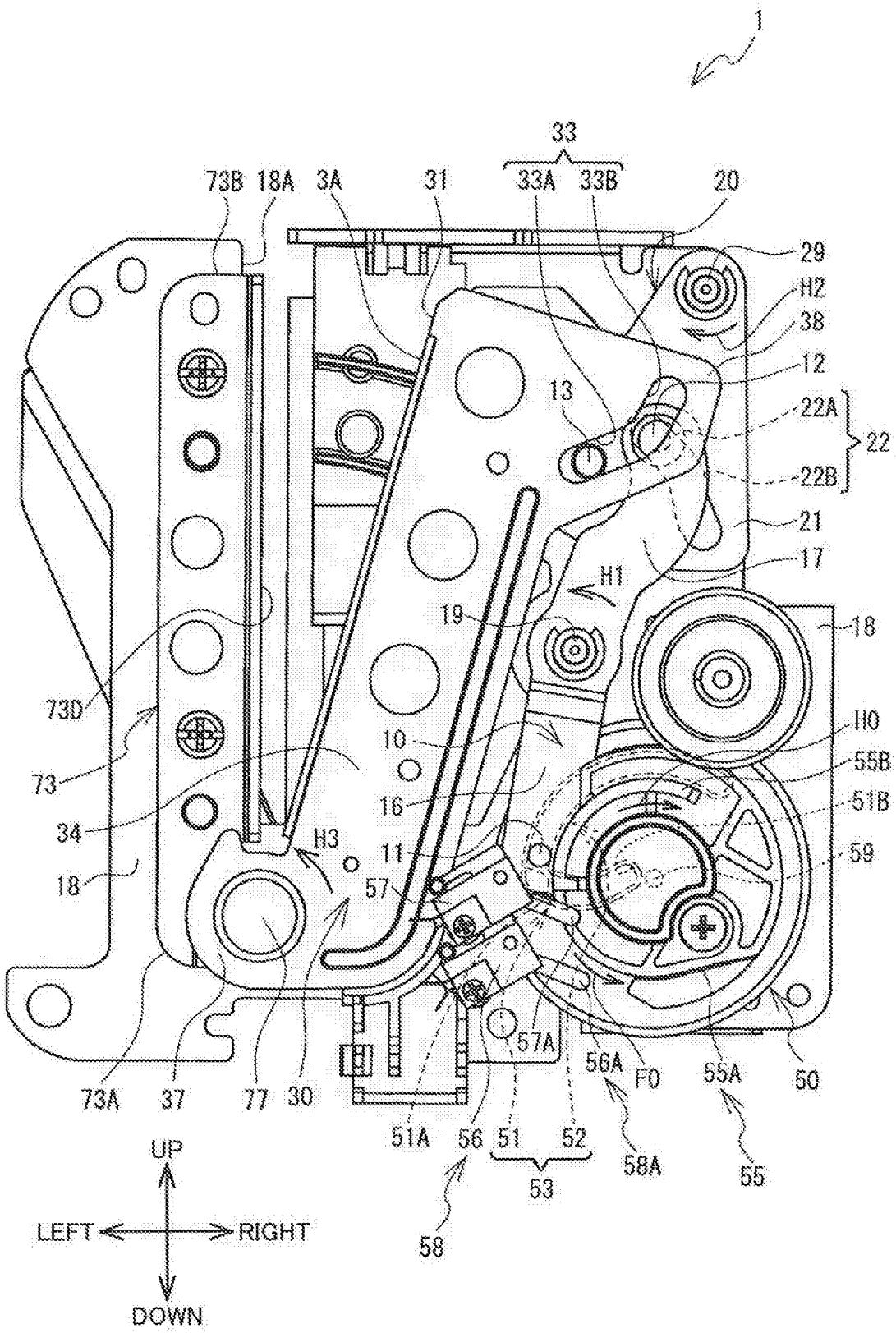
FIG. 3 is a front elevational view of the cutter 30 located at the wait position.

As illustrated in FIGS. 2 and 3, the rotor 50 is provided with a first protruding portion 55A and a second protruding portion 55B protruding frontward. Each of the first protruding portion 55A and the second protruding portion 55B has a curved-plate shape and extends along an arc centered about the rotation axis of the rotor 50. In the following description, the first protruding portion 55A and the second protruding portion 55B may be collectively referred to as "protruding portion 55". As illustrated in FIG. 3, the rotor 50 is provided with a first grooved cam 51 and a specific grooved cam 52. The first grooved cam 51 and the specific grooved cam 52 are formed continuous to and integrally with each other. The first grooved cam 51 extends from a start-end portion 51A to a terminal-end portion 51B in a direction directed toward the shaft 59 that is the rotation center of the rotor 50. The start-end portion 51A and the terminal-end portion 51B are opposite ends of the first grooved cam 51. The specific grooved cam 52 extends in an arc shape from the start-end portion 51A of the first grooved cam 51 in the clockwise direction about the shaft 59 in front elevational view. In the following description, the first grooved cam 51 and the specific grooved cam 52 may be collectively referred to as "rotor grooved cam 53".

As illustrated in FIGS. 2 and 3, a first switch 56 and a second switch 57 secured to the flat-plate portion 18 are provided to the left of the rotor 50. The first switch 56 includes a contact piece 56A diagonally extending in the right and down direction. The second switch 57 includes a contact piece 57A diagonally extending in the right and down direction. In the following description, the first switch 56 and the second switch 57 may be collectively referred to as "switch 58". The contact pieces 56A, 57A may be collectively referred to as "contact piece 58A". In the case where the protruding portion 55 of the rotor 50 is not in contact with the contact piece 58A, the switch 58 outputs an OFF signal to an application-specific integrated circuit (ASIC) 61 (see FIG. 8). In the case where the protruding portion 55 is in contact with the contact piece 58A by rotation of the rotor 50, the switch 58 outputs an ON signal to the ASIC 61.

A first support shaft 19 is provided on an upper left side of the rotor 50 and at a substantially center of the flat-plate portion 18 in the up and down direction. The first support shaft 19 protrudes frontward from the flat-plate portion 18. A first linkage member 10 is pivotably supported by the first support shaft 19. The first linkage member 10 extends in the up and down direction and has a through hole, not illustrated, extending through the first linkage member 10 in the front and rear direction at a substantially center thereof in the up and down direction. The first support shaft 19 is inserted in the through hole of the first linkage member 10. The first linkage member 10 is opposed to the flat-plate portion 18 in the front and rear direction with a space therebetween.

Figure 4:
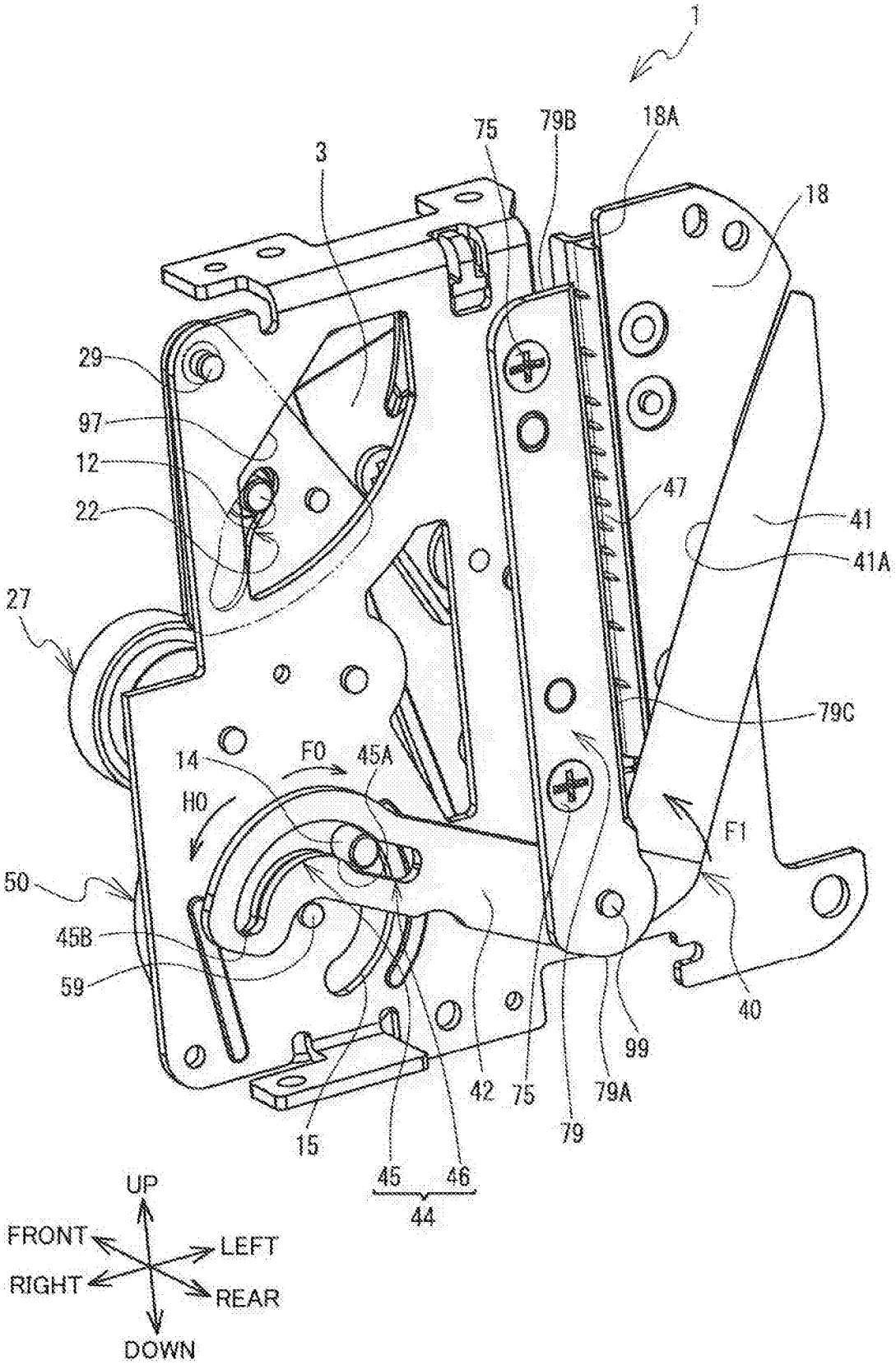
FIG. 4 is a perspective view of a full-cut blade 40 located at a separated position.

A lower end portion of the first linkage member 10 is a first linkage one end portion 16. As illustrated in FIG. 3, the first linkage one end portion 16 is provided with a first pin 11 protruding rearward. The first pin 11 is engaged with the rotor grooved cam 53. Rotation of the rotor 50 slides the first grooved cam 51 on the first pin 11, causing the first linkage member 10 to pivot about the first support shaft 19. An upper end portion of the first linkage member 10 is a first linkage other end portion 17 provided with a second pin 12 protruding rearward. A distal end of the second pin 12 is inserted in a through hole 97 (see FIG. 4) formed in an upper right portion of the flat-plate portion 18. As illustrated in FIG. 4, the through hole 97 has a deformed trapezoid shape when viewed from a back side. The through hole 97 extends through the flat-plate portion 18 in the front and rear direction. Even when the second pin 12 has pivoted by pivotal movement of the first linkage member 10, the second pin 12 does not contact the through hole 97.

As illustrated in FIGS. 2 and 3, a second linkage member 20 is provided between the first linkage other end portion 17 of the first linkage member 10 and the flat-plate portion 18 in the front and rear direction. The second linkage member 20 is pivotably supported by a second support shaft 29. The second support shaft 29 is provided at an upper right end of the flat-plate portion 18 at a position located to the right of the other end 73B of the receiving stage 73. The second support shaft 29 protrudes frontward from the flat-plate portion 18. The second linkage member 20 is a plate-like member having a fan shape centered about the second support shaft 29. The second linkage member 20 is in contact with the flat-plate portion 18 so as to be opposed to the flat-plate portion 18 on a front side thereof. One of opposite end portions of the second linkage member 20 which is farther from the second support shaft 29 than the other is a second linkage one end portion 21 that is opposed to the first linkage other end portion 17 on a rear side thereof.

The second linkage one end portion 21 is provided with a second grooved cam 22 engaged with the second pin 12. As illustrated in FIG. 3, the second grooved cam 22 includes a first cam portion 22A and a second cam portion 22B. The first cam portion 22A and the second cam portion 22B are grooved cams formed continuous to and integrally with each other. The first cam portion 22A is nearer to the second support shaft 29 than the second cam portion 22B. The first cam portion 22A extends in a direction away from the second support shaft 29, and the second cam portion 22B extends from the first cam portion 22A in a direction further away from the second support shaft 29. Pivotal movement of the first linkage member 10 slides the second pin 12 in the second grooved cam 22, causing the second linkage member 20 to pivot about the second support shaft 29. A third pin 13 protruding frontward is provided on the second linkage one end portion 21. When each of the first linkage member 10 and the second linkage member 20 is located at a pivot position illustrated in FIGS. 2 and 3, that is, when a cutter 30 which will be described below is located at a wait position, the first linkage other end portion 17 is nearest to the third pin 13.

The cutter 30 having a planar plate shape is provided on a front side of the first linkage other end portion 17. The cutter 30 is pivotably supported by the shaft member 77. As illustrated in FIG. 2, the cutter 30 includes a basal end portion 37, a distal end portion 38, a fixing portion 34, the cutting blade 3, and a contact portion 31. The basal end portion 37 is a lower end portion of the cutter 30. The basal end portion 37 is pivotable coupled to the shaft member 77 at a position located on a front side of the one end 73A of the receiving stage 73. The distal end portion 38 is an upper end portion of the cutter 30 and opposed to the first linkage other end portion 17 on a front side thereof. The fixing portion 34 extends between the basal end portion 37 and the distal end portion 38. The cutting blade 3 is a plate-like member having a thickness in the front and rear direction and secured to a rear surface of the fixing portion 34. A left end of the cutting blade 3 is a cutting edge 3A. The cutting edge 3A slightly protrudes leftward from the fixing portion 34 along a pivot direction of the cutter 30 in which the cutter 30 pivots. The cutting edge 3A is opposed to the receiving plate 73D of the receiving stage 73 along the pivot direction of the cutter 30. The contact portion 31 protrudes leftward from the distal end portion 38 along the pivot direction of the cutter 30 and is opposed to the receiving plate 73D along the pivot direction of the cutter 30. A distal end (i.e., a left end) of the contact portion 31 is located slightly to the left of the cutting edge 3A.

The distal end portion 38 is provided with a third grooved cam 33 that is engaged with the third pin 13. As illustrated in FIG. 3, the third grooved cam 33 has a first groove 33A and a second groove 33B. The first groove 33A and the second groove 33B are two grooved cams formed continuous to and integrally with each other. The first groove 33A extends in a direction away from the shaft member 77 (see FIG. 3), and the second groove 33B extends from the shaft member 77 in a direction further away from the first groove 33A. The first groove 33A and the second groove 33B extend in different directions.

Figure 5:
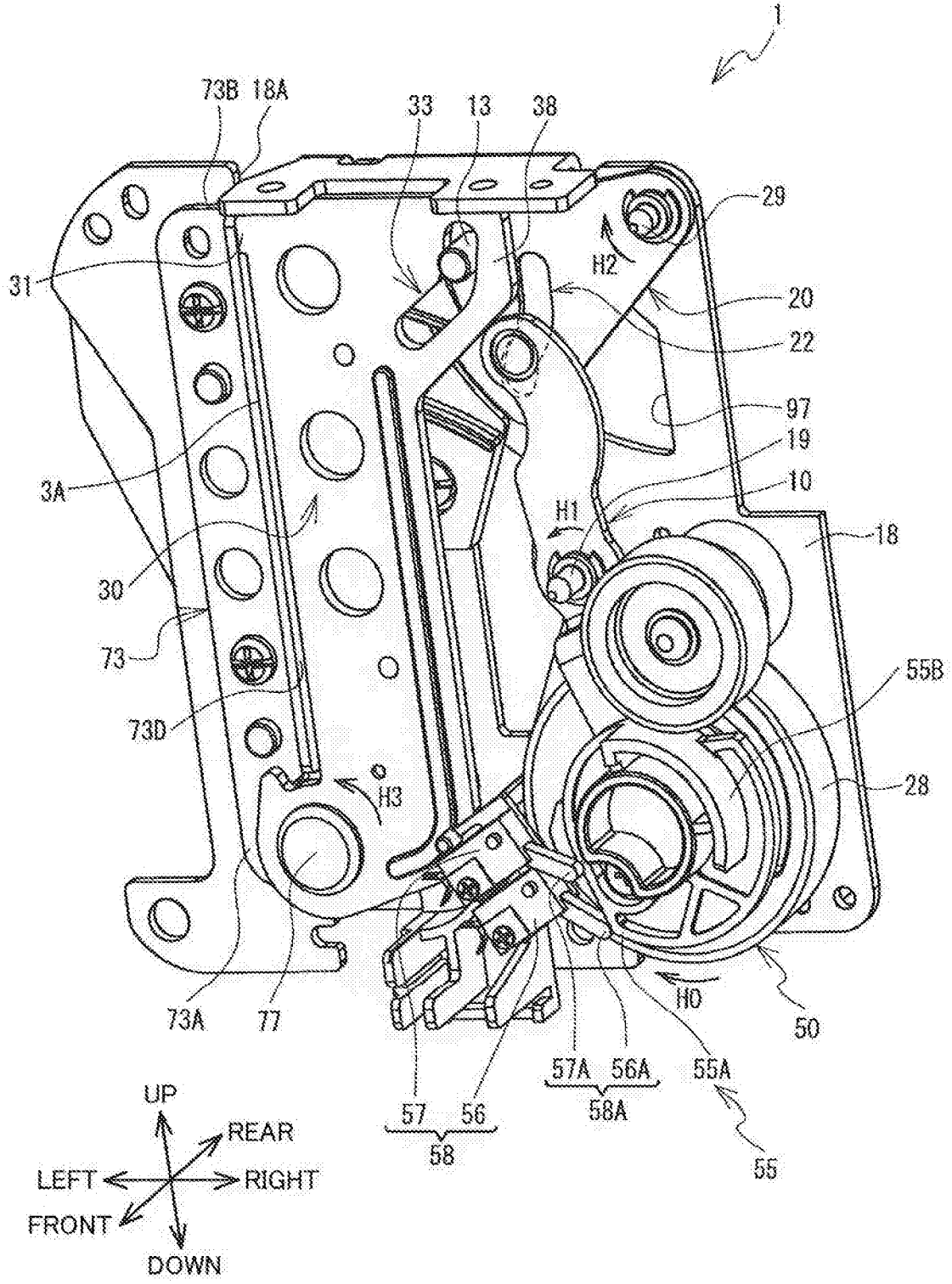
FIG. 5 is a perspective view of the cutter 30 located at a cutting position.
Figure 6:
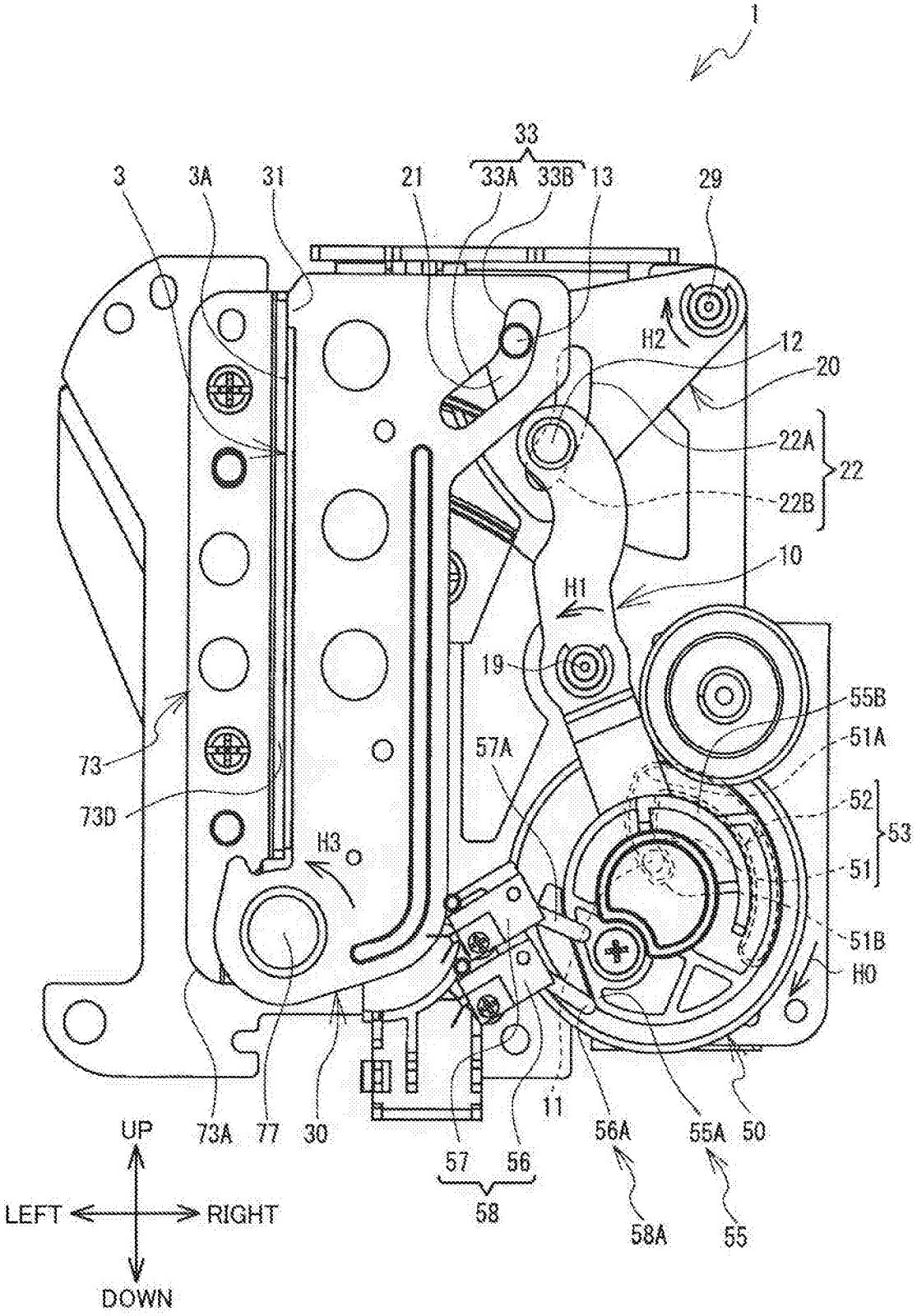
FIG. 6 is a front elevational view of the cutter 30 located at the cutting position.

Pivotal movement of the second linkage member 20 slides the third pin 13 in the third grooved cam 33, causing the cutter 30 to pivot about the shaft member 77 between a cutting position (see FIGS. 5 and 6) and the wait position (see FIGS. 2 and 3). The cutting position is a pivot position of the cutter 30 at which the cutting edge 3A of the cutting blade 3 of the cutter 30 is located near the receiving plate 73D of the receiving stage 73, and the distal end of the contact portion 31 is in contact with the receiving plate 73D. The wait position is a pivot position of the cutter 30 at which the cutting edge 3A of the cutting blade 3 of the cutter 30 is spaced apart from the receiving plate 73D of the receiving stage 73 by rightward movement of the cutter 30 from the cutting position. As illustrated in FIGS. 5 and 6, when the cutter 30 is located at the cutting position, the contact portion 31 is in contact with the receiving stage 73, but there is a small space between the cutting edge 3A of the cutting blade 3 and the receiving stage 73. The length of this space in the right and left direction is substantially equal to the thickness of the release paper sheet of the printing medium 7. As illustrated in FIGS. 2 and 3, when the cutter 30 is located at the wait position, the cutting edge 3A is spaced apart from and located to the right of the printing medium 7 placed on the receiving plate 73D.

As illustrated in FIG. 4, the fixed blade 79 and the full-cut blade 40 are provided at a rear of the flat-plate portion 18. The fixed blade 79 is secured to the flat-plate portion 18 by two screws 75, with a space between the fixed blade 79 and the flat-plate portion 18 in the front and rear direction. The fixed blade 79 is located on a right side of the medium-passing hole 18A. The fixed blade 79 is a rectangular plate-like member extending in the up and down direction when viewed from a back side. The fixed blade 79 includes one end 79A, the other end 79B, and a cutting edge 79C. The one end 79A is a lower end of the fixed blade 79. A fixed shaft 99 is secured to the one end 79A, and the axial direction of the fixed shaft 99 coincides with the front and rear direction. The fixed shaft 99 protrudes frontward though not illustrated in detail. The other end 79B is an upper end of the fixed blade 79. The cutting edge 79C is a left end of the fixed blade 79 and extends in the up and down direction. The printing medium 7 is placed at the cutting edge 79C between the one end 79A and the other end 79B.

The full-cut blade 40 is a plate-like member having an L-shape in front elevational view and pivotably supported by the fixed shaft 99. The full-cut blade 40 includes: a first arm 41 extending upward from the fixed shaft 99; and a second arm 42 extending rightward from the fixed shaft 99. The first arm 41 has a cutting edge 41A extending along a direction in which the first arm 41 extends. The cutting edge 41A is opposed to the cutting edge 79C of the fixed blade 79 along a pivot direction of the full-cut blade 40 in which the full-cut blade 40 pivots. When the full-cut blade 40 is located at a full-cut position which will be described below (see FIG. 7), a rear surface of the cutting edge 41A of the first arm 41 and a front surface of the cutting edge 79C of the fixed blade 79 are in contact with each other.

A fourth grooved cam 44 extends through a right portion of the second arm 42 in the front and rear direction. A fourth pin 14 protruding rearward from the rotor 50 is engaged with the fourth grooved cam 44. The fourth pin 14 is inserted in an arc hole 15 formed in the flat-plate portion 18 and protrudes rearward. The arc hole 15 extends through the flat-plate portion 18 in the front and rear direction and extends in an arc shape centered about the shaft 59.

The fourth grooved cam 44 includes an arc cam 45 and a drawn cam 46. The arc cam 45 and the drawn cam 46 are grooved cams formed continuous to and integrally with each other. The arc cam 45 has a start-end portion 45A and a terminal end 45B as opposite ends. The arc cam 45 extends from the start-end portion 45A to the terminal end 45B in an arc shape in the counterclockwise direction about the shaft 59 when viewed from a back side. The drawn cam 46 extends straight from the start-end portion 45A of the arc cam 45 to the fixed shaft 99. The radius of the arc cam 45 is equal to a distance between the center of the fourth pin 14 and the center of the shaft 59.

Figure 7:
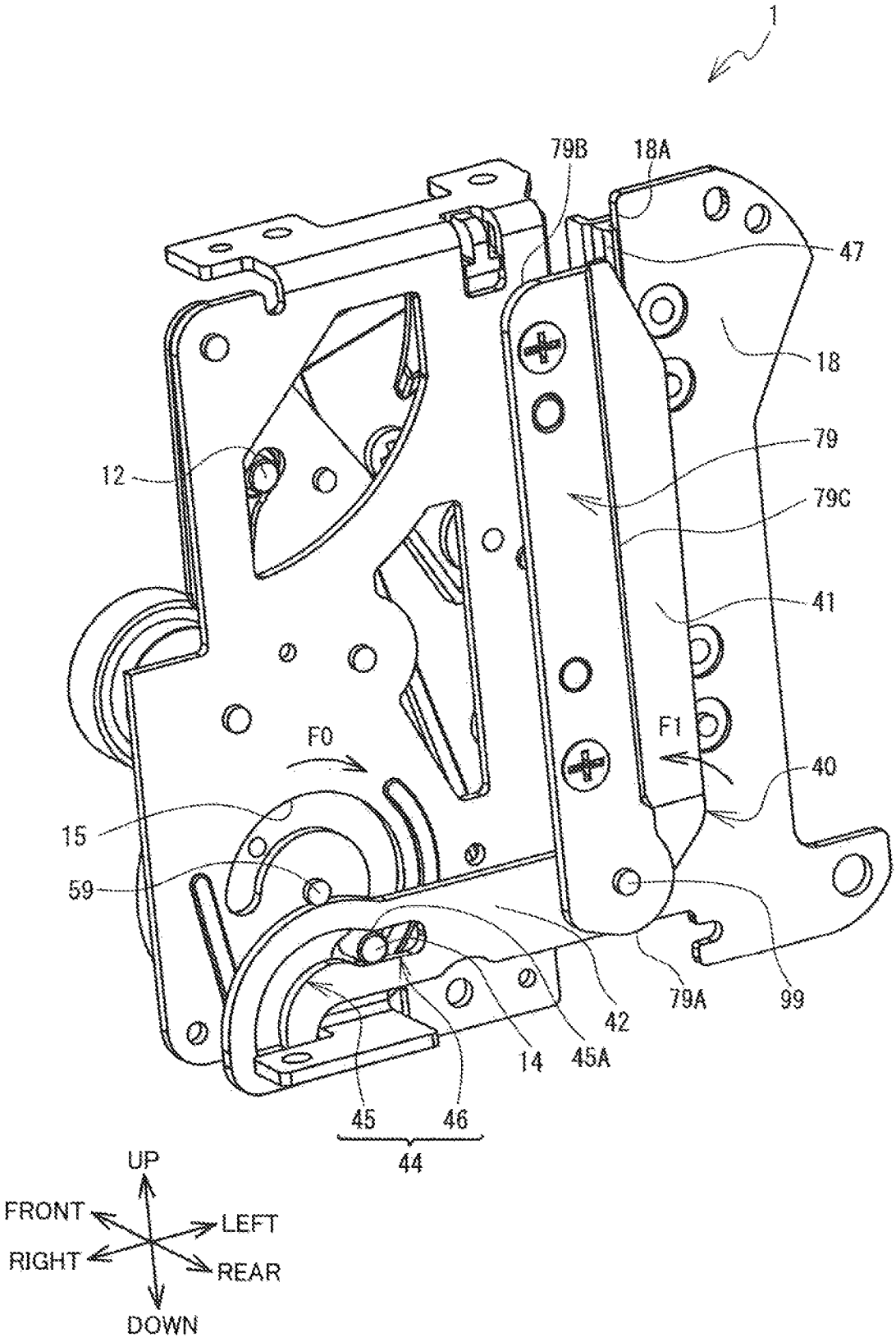
FIG. 7 is a perspective view of the full-cut blade 40 located at a full-cut position.

Rotation of the rotor 50 slides the fourth pin 14 in the drawn cam 46, causing the full-cut blade 40 to pivot about the fixed shaft 99 between the full-cut position (see FIG. 7) and a separated position (see FIG. 4). As illustrated in FIG. 7, the full-cut position is a pivot position of the full-cut blade 40 at which the cutting edge 41A is located to the right of the cutting edge 79C of the fixed blade 79. As illustrated in FIG. 4, the separated position is a pivot position of the full-cut blade 40 at which the cutting edge 41A is spaced apart from and located to the left of the printing medium 7 placed at the cutting edge 79C. The pivot direction of the full-cut blade 40 is parallel with the pivot direction of the cutter 30.

Figure 8:
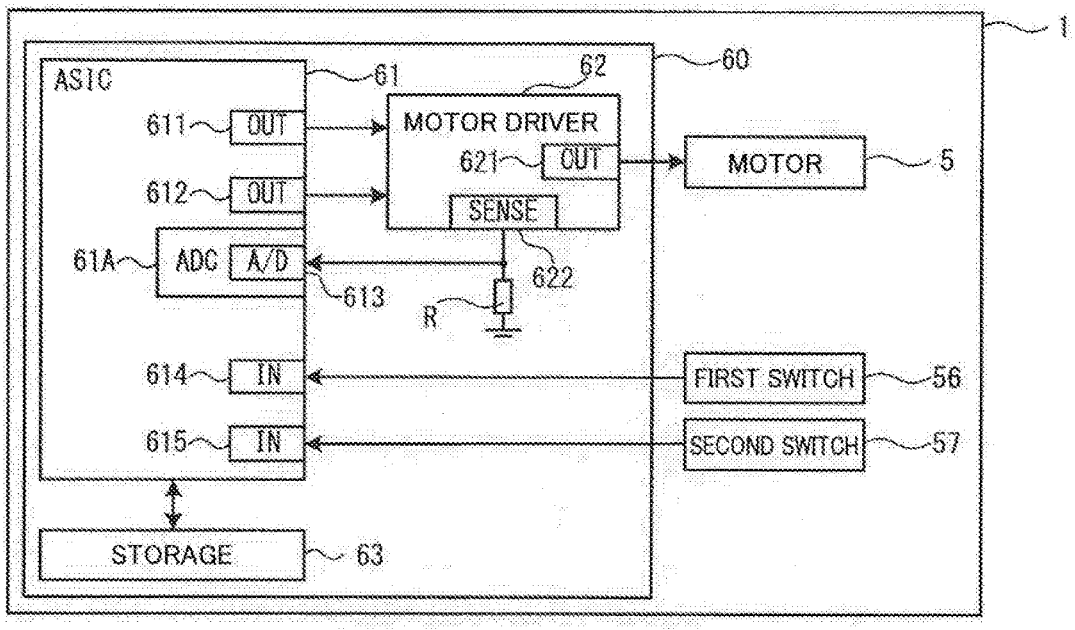
FIG. 8 is a block diagram illustrating an electric configuration of a cutting apparatus 1.

FIG. 8 illustrates a control board 60 for controlling the cutting apparatus 1. The ASIC 61, the motor driver 62, and a storage 63 are mounted on the control board 60. The ASIC 61 executes overall cutting control for the cutting apparatus 1. The ASIC 61 is electrically connected to the motor driver 62, the storage 63, the first switch 56, and the second switch 57. The motor driver 62 is electrically connected to the motor 5.

The ASIC 61 sets a current limit value and an operation mode to the motor driver 62 to control the motor driver 62 to rotate the motor 5. That is, the ASIC 61 controls the motor 5 via the motor driver 62. The ASIC 61 includes OUT terminals 611, 612, an A/D terminal 613, IN terminals 614, 615, and an A/D converter 61A. The OUT terminal 611 outputs a signal related to the current limit value for the motor 5. The OUT terminal 612 outputs a signal related to the operation mode (a slow decay mode or a fast decay mode) of the motor 5.

A SENSE terminal 622 of the motor driver 62 and one end of a resistor R are connected to the A/D terminal 613. The other end of the resistor R is grounded. The A/D converter 61A converts the voltage level of the A/D terminal 613 from an analog value to a digital value. As will be described below in detail, the SENSE terminal 622 of the motor driver 62 outputs a current to energize the resistor R, and the value of this current is equal to a value of a current to be passed through the motor 5. In this case, a voltage related to the passing current is generated at both ends of the resistor R. The A/D converter 61A converts the level of the voltage generated at the resistor R by the passing current, from an analog value to a digital value. Thus, the ASIC 61 is capable of identifying a voltage generated between both ends of the resistor R based on a digital value obtained by the A/D converter 61A to detect a current passed through the motor 5, based on a relationship between the identified voltage and the resistor R. A signal output from the first switch 56 is input to the IN terminal 614. A signal output from the second switch 57 is input to the IN terminal 615.

The motor driver 62 is a driver element for driving the motor 5 based on control of the ASIC 61. The motor driver 62 includes an OUT terminal 621 and the SENSE terminal 622. The OUT terminal 621 is connected to the motor 5. The motor driver 62 controls a current to be passed through the motor 5 via the OUT terminal 621, at each predetermined step. Thus, the motor driver 62 rotates the motor 5. The motor driver 62 prevents a current greater than the current limit value related to the level of the voltage output from the OUT terminal 611 of the ASIC 61, from being passed through the motor 5. The motor driver 62 controls the current to be passed through the motor 5 via the OUT terminal 621, based on the voltage output from the OUT terminal 612 of the ASIC 61, such that the motor 5 is driven in any of the slow decay mode and the fast decay mode. The SENSE terminal 622 outputs a current to energize the resistor R, and the value of this current is equal to the value of the current to be passed through the motor 5.

The storage 63 stores, programs for execution of various processings by the ASIC 61, the number of half cuts, the number of full cuts, a table 631 (see FIG. 11) which will be described below, a second set value, and so on. The number of half cuts stores the number of half cuts performed by the cutting apparatus 1. The number of full cuts stores the number of full cuts performed by the cutting apparatus 1. When the half cut or the full cut is performed by the cutting apparatus 1, the ASIC 61 adds one to the number of half cuts or the number of full cuts stored in the storage 63 and updates it. The table 631 stores a plurality of first set values. The second set value is a predetermined value that is less than any of the first set values stored in the table 631.

Cutting Operation (Half Cut)

There will be next described operations of the cutting apparatus 1 for performing the half cut in the printing medium 7 with reference to FIGS. 2, 3, 5, and 6. Before the start of the half-cut operation, the printing medium 7 has been conveyed by the rollers of the printing apparatus 100 to a position at which the printing medium 7 has passed through the medium-passing hole 18A, and the printing medium 7 is placed on the receiving plate 73D. At this time, the release paper sheet of the printing medium 7 is opposed to the receiving plate 73D. Before the start of the half-cut operation, the cutting apparatus 1 is in a standby state (see FIGS. 2, 3, and 4). When the cutting apparatus 1 is in the standby state, the first pin 11 is in contact with the start-end portion 51A, the second pin 12 is in contact with an upper end of the first cam portion 22A, the third pin 13 is in contact with a lower portion of the first groove 33A, the cutter 30 is located at the wait position, the fourth pin 14 is in contact with the start-end portion 45A, and the full-cut blade 40 is located at the separated position. In this state, the contact piece 58A of each of the first switch 56 and the second switch 57 is not in contact with the protruding portion 55 of the rotor 50 and outputs the OFF signal (see FIG. 9).

Figure 10A:
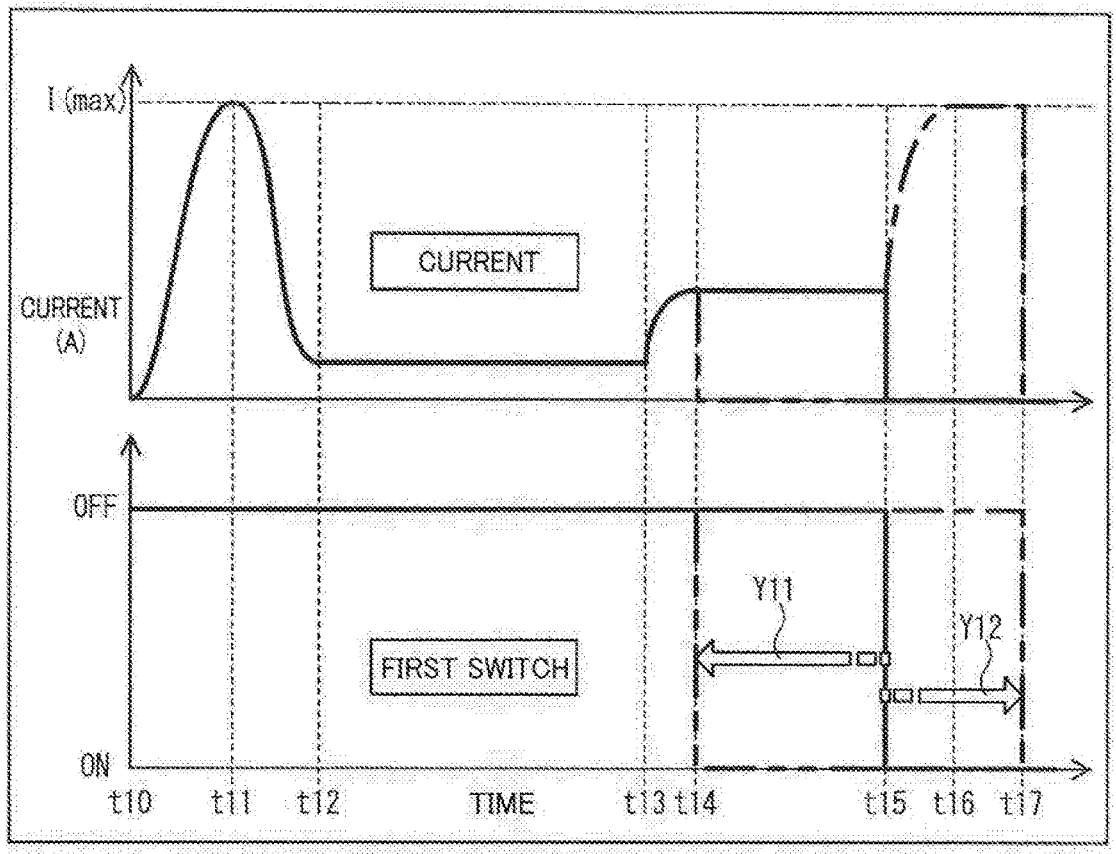
FIGS. 10A and 10B are timing charts each representing a relationship between a current to be passed through a motor 6, and a signal output from a first switch 56.

The ASIC 61 controls the motor driver 62 to start energizing the motor 5. The motor 5 (see FIG. 8) starts rotating in a predetermined one direction (hereinafter referred to as "forward direction"). As illustrated in FIG. 10A, just after the start of rotation of the motor 5, torque on the motor 5 sharply increases, and accordingly a current passing through the motor 5 also sharply increases (time t10-t11). Thereafter, the current passing through the motor 5 decreases with decrease in torque on the motor 5 (time t11-t12), and thereafter the current stays at a constant level (time t12-t13). It is noted that the motor driver 62 controls the current passing through the motor 5, such that the current is not greater than a current limit value I(max).

As illustrated in FIG. 3, rotation of the motor 5 rotates the gear train 24, which rotates the rotor 50 in the clockwise direction in front elevational view (arrow H0). When the first grooved cam 51 of the rotor 50 is rotated in the clockwise direction, the first grooved cam 51 presses and moves the first pin 11 rightward (see FIGS. 3 and 6). As a result, the first linkage member 10 pivots in the counterclockwise direction in front elevational view (arrow H1). The pivotal movement of the first linkage member 10 causes the second pin 12 to press and move the first cam portion 22A of the second grooved cam 22 leftward. That is, the second linkage member 20 pivots in the clockwise direction in front elevational view (arrow H2) while sliding on the flat-plate portion 18. The pivotal movement of the second linkage member 20 causes the third pin 13 to press and move the first groove 33A of the third grooved cam 33 leftward. As a result, the cutter 30 pivots from the wait position toward the cutting position (arrow H3).

As illustrated in FIG. 4, the fourth pin 14 slides from the start-end portion 45A toward the terminal end 45B of the arc cam 45 during the pivotal movement of the cutter 30 toward the cutting position. Since the radius of the arc cam 45 is equal to the distance between the center of the fourth pin 14 and the center of the shaft 59, the second arm 42 does not pivot even when the fourth pin 14 slides. Accordingly, the full-cut blade 40 is kept stopped at the separated position.

As illustrated in FIG. 6, during sliding of the first pin 11 toward the terminal-end portion 51B due to the rotation of the rotor 50, the second pin 12 slides from the first cam portion 22A to the second cam portion 22B, and the third pin 13 slides from the first groove 33A to the second groove 33B. The cutter 30 continues pivoting. It is noted that, until the cutter 30 reaches the cutting position, the contact piece 58A of each of the first switch 56 and the second switch 57 is not in contact with the protruding portion 55 of the rotor 50 and continues to output the OFF signal (time t10-t15 in FIG. 10A, see FIG. 9).

The printing medium 7 is nipped between the cutter 30 and the receiving plate 73D of the receiving stage 73. The receiving plate 73D supports the printing medium 7, and the cutting edge 3A of the cutter 30 starts making a cut gradually in the printing medium 7 from a lower side thereof. In this operation, as illustrated in FIG. 10A, the torque on the motor 5 increases, and the current passing through the motor 5 also increases (time t13-t14). The current passing through the motor 5 thereafter stays at a constant level (time t14-t15).

As illustrated in FIGS. 5 and 6, after the cut reaches the upper end of the printing medium 7, the contact portion 31 comes into contact with the receiving plate 73D, and the cutter 30 reaches the cutting position (see time t15 in FIG. 10A). In this state, the contact piece 56A of the first switch 56 is in contact with the first protruding portion 55A of the rotor 50 and outputs the ON signal (see time t15 in FIG. 10A and FIG. 9). The first switch 56 detects that the cutter 30 has reached the cutting position. The contact piece 57A of the second switch 57 is not in contact with the protruding portion 55 of the rotor 50 and outputs the OFF signal (see FIG. 9). As illustrated in FIGS. 5 and 6, the cutting edge 3A of the cutting blade 3 performs the half cut in the printing medium 7 across its width. When the signal output from the first switch 56 is switched from the OFF signal to the ON signal, the ASIC 61 controls the motor driver 62 to stop energizing the motor 5 (see time t15 in FIG. 10A). The driving of the motor 5 is stopped.

After the half cut is performed in the printing medium 7, the ASIC 61 controls the motor driver 62 to energize and rotate the motor 5 in a direction reverse to the forward direction (which will be hereinafter referred to as "reverse direction"). As a result, the rotor 50, the first linkage member 10, the second linkage member 20, and the cutter 30 are operated in a direction reverse to a direction at the start of the half-cut operation. The cutting apparatus 1 is switched back to the standby state. The driving of the motor 5 is finished, and the half-cut operation is completed.

Cutting Operation (Full Cut)

There will be next described operations of the cutting apparatus 1 for performing the full cut in the printing medium 7 conveyed to the medium-passing hole 18A, with reference to FIGS. 2, 3, 4, and 7. Before the start of the full-cut operation, the cutting apparatus 1 is in the standby state. The full-cut blade 40 is located at the separated position. In this state, the contact piece 58A of each of the first switch 56 and the second switch 57 is not in contact with the protruding portion 55 of the rotor 50 and outputs the OFF signal (see FIG. 9).

The ASIC 61 controls the motor driver 62 to start energizing the motor 5. The motor 5 starts rotating in the reverse direction. As a result, as illustrated in FIG. 3, the rotor 50 is rotated in the counterclockwise direction in front elevational view (arrow F0). In this operation, even when the specific grooved cam 52 of the rotor grooved cam 53 slides on the first pin 11, the first pin 11 does not move because the specific grooved cam 52 has the arc shape centered about the shaft 59. Thus, each of the first linkage member 10 and the second linkage member 20 does not pivot, and the cutter 30 is kept stopped at the wait position.

As illustrated in FIG. 4, the rotation of the rotor 50 slides the fourth pin 14 in the drawn cam 46 and presses and moves the second arm 42 in the counterclockwise direction. As a result, the full-cut blade 40 starts pivoting toward the full-cut position (arrow F1). In accordance with the sliding of the fourth pin 14 in the drawn cam 46, the printing medium 7 is gradually nipped between the cutting edge 41A of the full-cut blade 40 and the cutting edge 79C of the fixed blade 79 from a lower side. As a result, the printing medium 7 is gradually separated into two portions from the lower side. It is noted that, until the full-cut blade 40 reaches the full-cut position, the contact piece 56A of the first switch 56 is not in contact with the protruding portion 55 of the rotor 50 and continues to output the OFF signal (see FIG. 9). In contrast, the contact piece 57A of the second switch 57 contacts the second protruding portion 55B of the rotor 50 in this period and outputs the ON signal (see FIG. 9).

Figure 9:
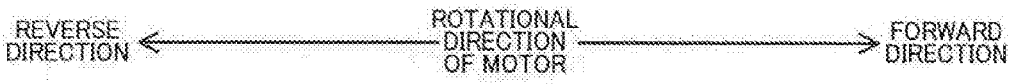
FIG. 9 is a table representing a relationship between a cutting state of the cutting apparatus 1 and an output signal of a switch 58.

After the cut is made through the printing medium 7 in the up and down direction, as illustrated in FIG. 7, the full-cut blade 40 reaches the full-cut position. In this state, as illustrated in FIG. 9, the contact piece 56A of the first switch 56 is in contact with the second protruding portion 55B of the rotor 50 and outputs the ON signal. Since the contact piece 57A of the second switch 57 is kept in contact with the second protruding portion 55B of the rotor 50, the second switch 57 continues to output the ON signal.

When the signal output from the first switch 56 is switched from the OFF signal to the ON signal, the ASIC 61 controls the motor driver 62 to stop energizing the motor 5. The driving of the motor 5 is stopped. After the full cut is performed in the printing medium 7, the ASIC 61 controls the motor driver 62 to energize and rotate the motor 5 in the forward direction. As a result, the rotor 50 and the full-cut blade 40 are operated in a direction reverse to a direction at the start of the full-cut operation. The cutting apparatus 1 is switched back to the standby state. The driving of the motor 5 is finished, and the full-cut operation is completed.

Overview 1 of Present Embodiment

The timing of detection of the first switch 56 in some cases varies due to an error in detection of the first switch 56, an error in dimension of any of the cutter 30 and various cams, and an error in assembly of the components, for example. Specifically, for example, as illustrated in FIG. 10A, the timing at which the signal output from the first switch 56 is switched from the OFF signal to the ON signal is earlier in some cases (arrow Y11) or later in other cases (arrow Y12) than time t15 at which the contact portion 31 actually comes into contact with the receiving plate 73D, and the cutter 30 has reached the cutting position.

For example, FIG. 10A illustrates a case where the timing at which the signal output from the first switch 56 is switched from the OFF signal to the ON signal is time t17 that is later than the time t15 (arrow Y12). In this case, the ASIC 61 controls the motor driver 62 to continue to energize the motor 5 while the signal output from the first switch 56 is the OFF signal. Since the contact portion 31 comes into contact with the receiving plate 73D at time t15, and the cutter 30 has reached the cutting position, rotation of the motor 5 is reduced, and the torque increases. Thus, the current passing through the motor 5 increases and reaches the current limit value I(max) (time t15-t16). The motor driver 62 prevents a current greater than the current limit value I(max) from passing through the motor 5. Thus, the motor driver 62 continues to pass the current of the current limit value I(max) through the motor 5 (time t16-t17). The ASIC 61 controls the motor driver 62 to stop energizing the motor 5 when the signal output from the first switch 56 is switched from the OFF signal to the ON signal at time t17.

In this case, the motor driver 62 continues to pass the current of the current limit value I(max) through the motor 5 in a period between time t16 and time t17, thereby keeping a state in which the contact portion 31 of the cutter 30 is pressed against the receiving plate 73D by a large force. This may lead to lower durability of the cutter 30 unfortunately.

Figure 10B:
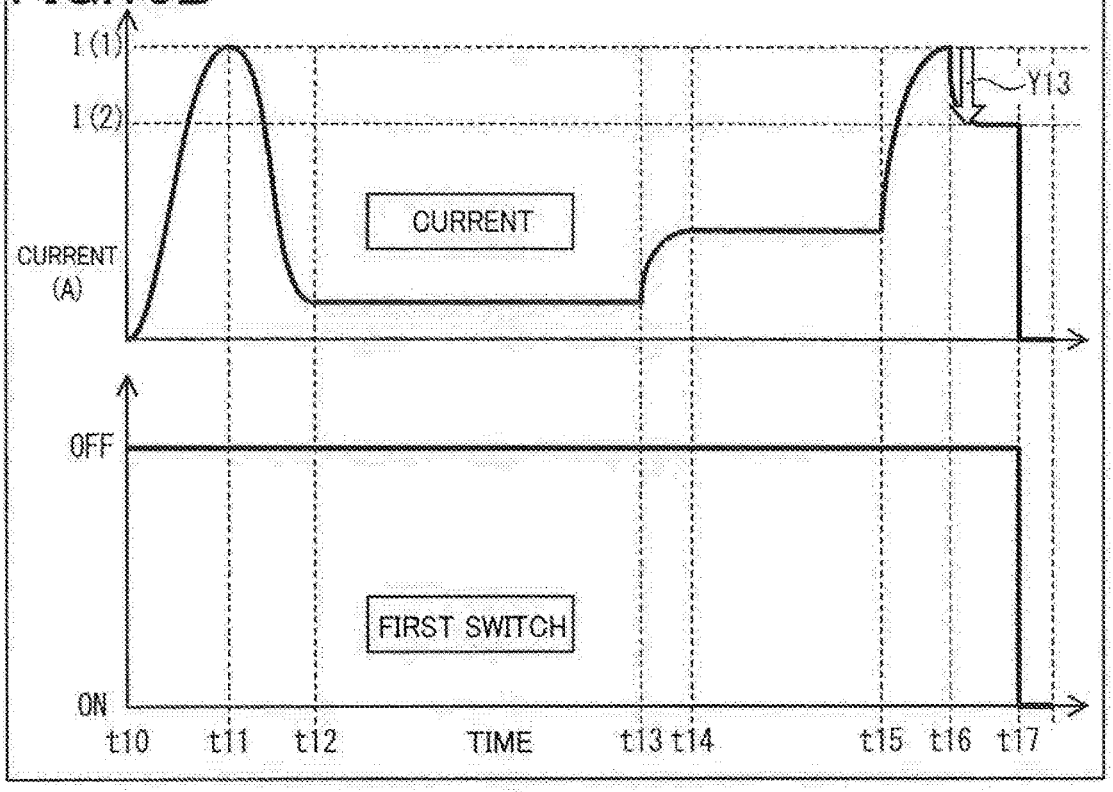

In the present embodiment, in contrast, the ASIC 61 identifies the voltage generated between both ends of the resistor R (see FIG. 8) based on the digital value obtained by the A/D converter 61A to detect the current passed through the motor 5, based on the relationship between the identified voltage and the resistor R. The ASIC 61 compares the detected current with a first set value 41), which will be described below, set for the motor driver 62 as the current limit value I(max). When it is determined that the current passed through the motor 5 has reached the first set value 41), that is, when the current passed through the motor 5 has reached the first set value 41) at time t16 in FIG. 10B, even in the case where the signal output from the first switch 56 is the OFF signal continuously, the ASIC 61 changes the current limit value I(max) set for the motor driver 62, to a second set value I(2) that is less than the first set value 41). The motor driver 62 controls the current to be passed through the motor 5 such that the current passing through the motor 5 does not exceed the second set value I(2) (arrow Y13). When the signal output from the first switch 56 is thereafter switched from the OFF signal to the ON signal at time t17, the ASIC 61 controls the motor driver 62 to stop energizing the motor 5. Thus, the ASIC 61 reduces the current passing through the motor 5 in the state in which the contact portion 31 of the cutter 30 is in contact with the receiving plate 73D, thereby preventing the contact portion 31 from being pressed against the receiving plate 73D by a large force.

In the above-described operations, the current passing through the motor 5 is controlled by the motor driver 62 so as not to exceed the current limit value I(max). Thus, the first set value 41) is set for the motor 5 as the current limit value I(max), the current passing through the motor 5 does not exceed the first set value 41) ideally. However, there is a possibility that the current passing through the motor 5 is slightly greater than the first set value 41) due to an effect of an error in the motor driver 62, for example. Thus, to allow change of the current limit value I(max) from the first set value 41) to the second set value I(2) in such a case, the ASIC 61 determines whether or not the current passed through the motor 5 is greater than or equal to the first set value 41). That is, the processing for determining that the current passed through the motor 5 has reached the first set value 41) in the above-described description about the processing executed by the ASIC 61 corresponds to a processing for determining that the current passed through the motor 5 is greater than or equal to the first set value 41), more specifically. Accordingly, the wordings "determine whether or not the current is greater than or equal to the first set value" means "determine whether the current has reached the first set value" in the following description.

Overview 2 of Present Embodiment

The ASIC 61 determines the first set value set for the motor driver 62 as the current limit value, based on the width of the printing medium 7 and the number of cuts performed by the cutting apparatus 1. Specifically, this determination is as follows. FIG. 11 illustrates the table 631 stored in the storage 63 (see FIG. 8). The table 631 stores the first set values (expressed in A) each associated with the width of the printing medium 7 and the number of cuts N indicating the number of the half cuts performed by the cutting apparatus 1. Each of the numbers of cuts n1, n2 in the table 631 is a threshold value determined in advance by experiment. The number of each of the first set values in the table 631 is not limited to that in FIG. 11 and may be changed as needed.

In the table 631, the first set value is set to increase with increase in the width of the printing medium 7. This is because torque of the motor 5 which is required for the cutter 30 to perform the half cut in the printing medium 7 increases with increase in the width of the printing medium 7, and accordingly a higher current needs to be passed through the motor 5. Also, the first set value is set to increase with increase in the number of cuts. This is because the sharpness of the cutting blade 3 decreases due to wear with increase in the number of cuts performed by the cutting apparatus 1, and the torque of the motor 5 which is required for the cutter 30 to perform the half cut in the printing medium 7 increases with increase in the number of cuts performed by the cutting apparatus 1, and accordingly a higher current needs to be passed through the motor 5.

The ASIC 61 sets the first set value determined based on the table 631, to the motor driver 62. Thus, the ASIC 61 determines an appropriate first set value in accordance with the type of the printing medium 7 and the number of cuts performed by the cutting apparatus 1 and sets the determined first set value to the motor driver 62 as the current limit value.

Overview 3 of Present Embodiment

Figure 12A:
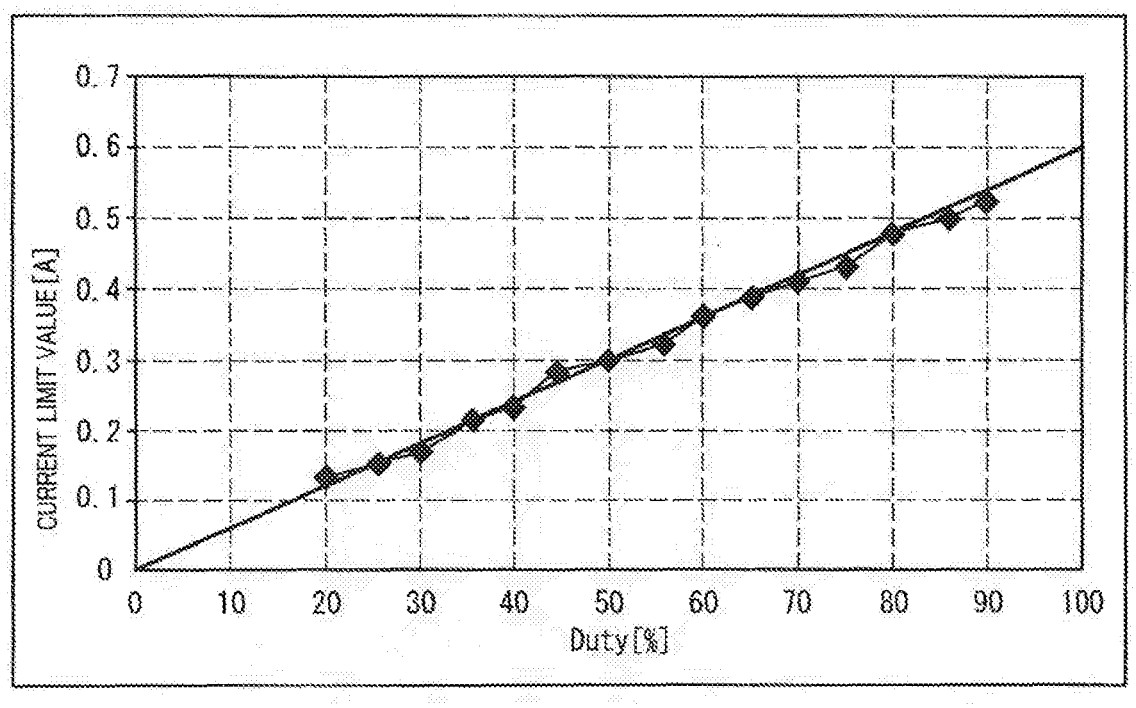
FIGS. 12A and 12B are graphs each representing a relationship between a duty ratio (Duty) in a current passing through a motor 5 and a current limit value.
Figure 12B:
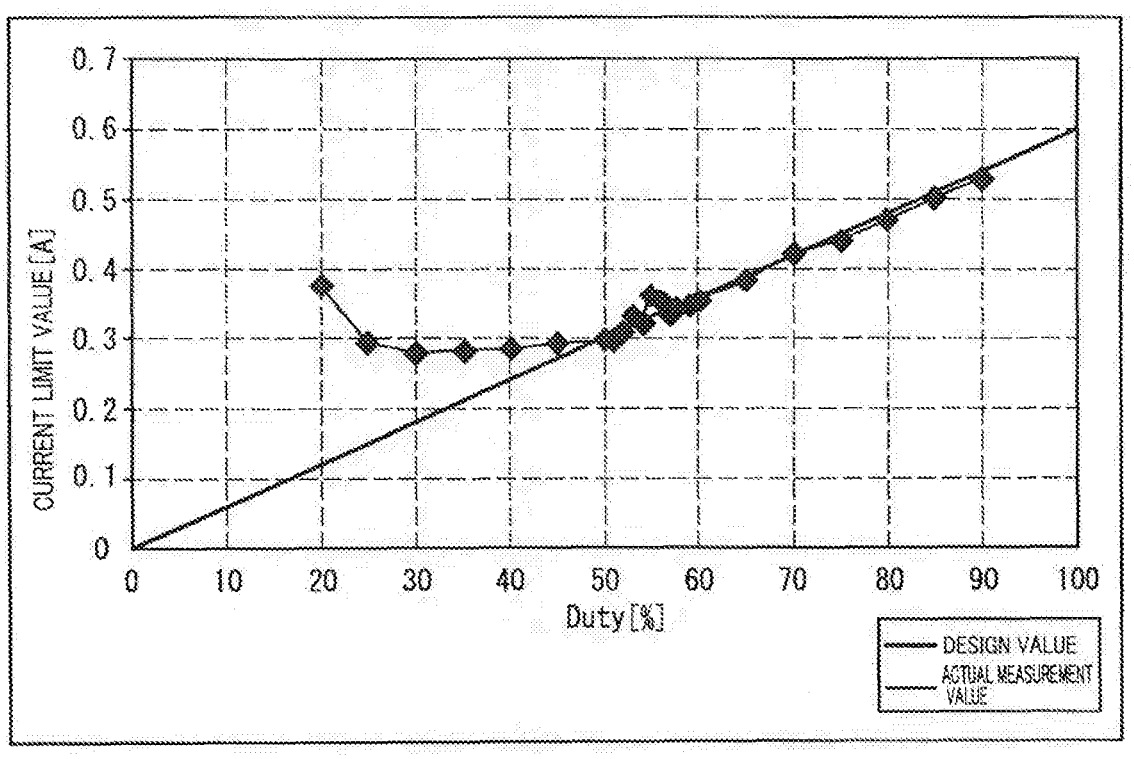

The motor driver 62 adjusts a duty ratio (DUTY) for the case where the current to be passed through the motor 5 is controlled at each step, to control the current passing through the motor 5, such that the current does not exceed the current limit value. FIG. 12 is a graph representing a relationship between the duty ratio in the current passed through the motor 5 by the motor driver 62, and the current limit value set to the motor driver 62. FIG. 12A corresponds to the case where the motor 5 is driven in the fast decay mode. FIG. 12B corresponds to the case where the motor 5 is driven in the slow decay mode.

As illustrated in FIG. 12A, in the case where the motor 5 is driven in the fast decay mode, a design value of the current which is calculated based on the duty ratio well coincides with an actual measurement value of the current limit value adjusted by the motor driver 62. Thus, the motor driver 62 can adjust the duty ratio to achieve at least the current limit values ranging between about 0.1 A and about 0.5 A. As illustrated in FIG. 12B, in the case where the motor 5 is driven in the slow decay mode, the actual measurement value of the current limit value adjusted by the motor driver 62 diverges from the design value of the current which is calculated based on the duty ratio. This is because, in the case where the motor 5 is driven in the slow decay mode, a length of time required for decay when displacement has occurred in the current increases relatively. Thus, even in the case where the duty ratio is reduced for the motor driver 62 to control the current to be passed through the motor 5, the current to be passed through the motor 5 cannot be controlled using a current limit value that is less than about 0.3 A. Thus, in the case where the ASIC 61 sets the slow decay mode for the motor driver 62, there is a possibility that the motor driver 62 cannot control the current passing through the motor 5, based on the set current limit value.

It is known that ripples of a waveform of the current passed through the motor 5 by the motor driver 62 are larger in the case where the motor 5 is driven in the fast decay mode than in the case where the motor 5 is driven in the slow decay mode. Since the ripples of the waveform of the current cause variations in torque, the motor 5 is preferably driven in the slow decay mode particularly in the case where the motor 5 is rotated continuously.

Thus, in the case where the first set value determined as the current limit value is greater than a predetermined threshold value Th (e.g., 0.3 A), the ASIC 61 determines the operation mode of the motor 5 to the slow decay mode and sets the slow decay mode to the motor driver 62 (see FIG. 12A). This reduces the occurrence of variations in torque. In the case where the first set value determined as the current limit value is less than or equal to the threshold value Th, the ASIC 61 determines the operation mode of the motor 5 to the fast decay mode and sets the fast decay mode to the motor driver 62 (see FIG. 12B). In the case where the ASIC 61 has changed the current limit value from the first set value to the second set value, the ASIC 61 determines the operation mode of the motor 5 to the fast decay mode and sets the fast decay mode to the motor driver 62. In this case, the motor driver 62 adjusts the duty ratio to energize the motor 5, thereby appropriately controlling the current to be passed through the motor 5, using the set current limit value.

Main Process

Figure 13:
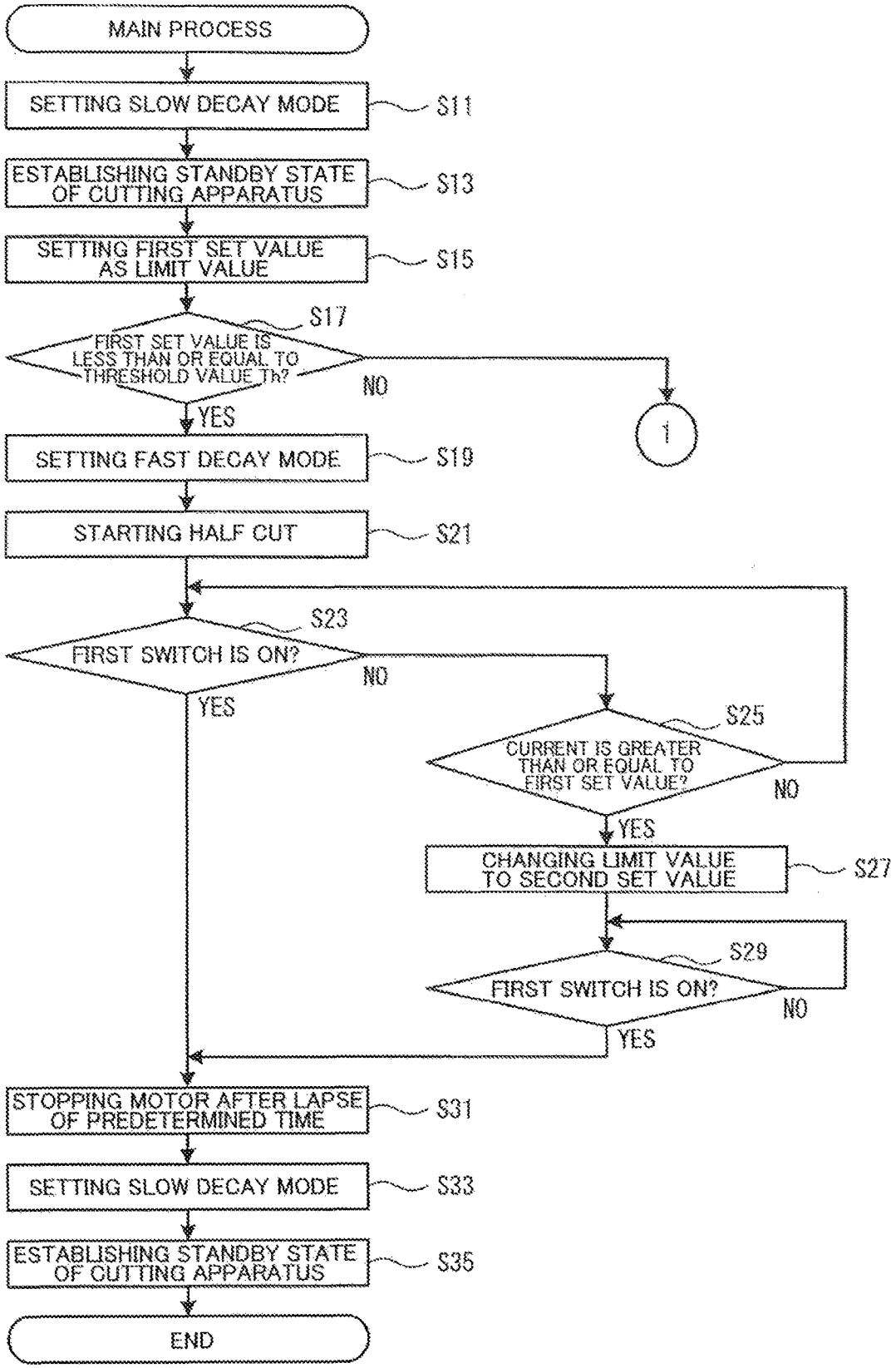
FIG. 13 is a flowchart representing a portion of a main process.
Figure 14:
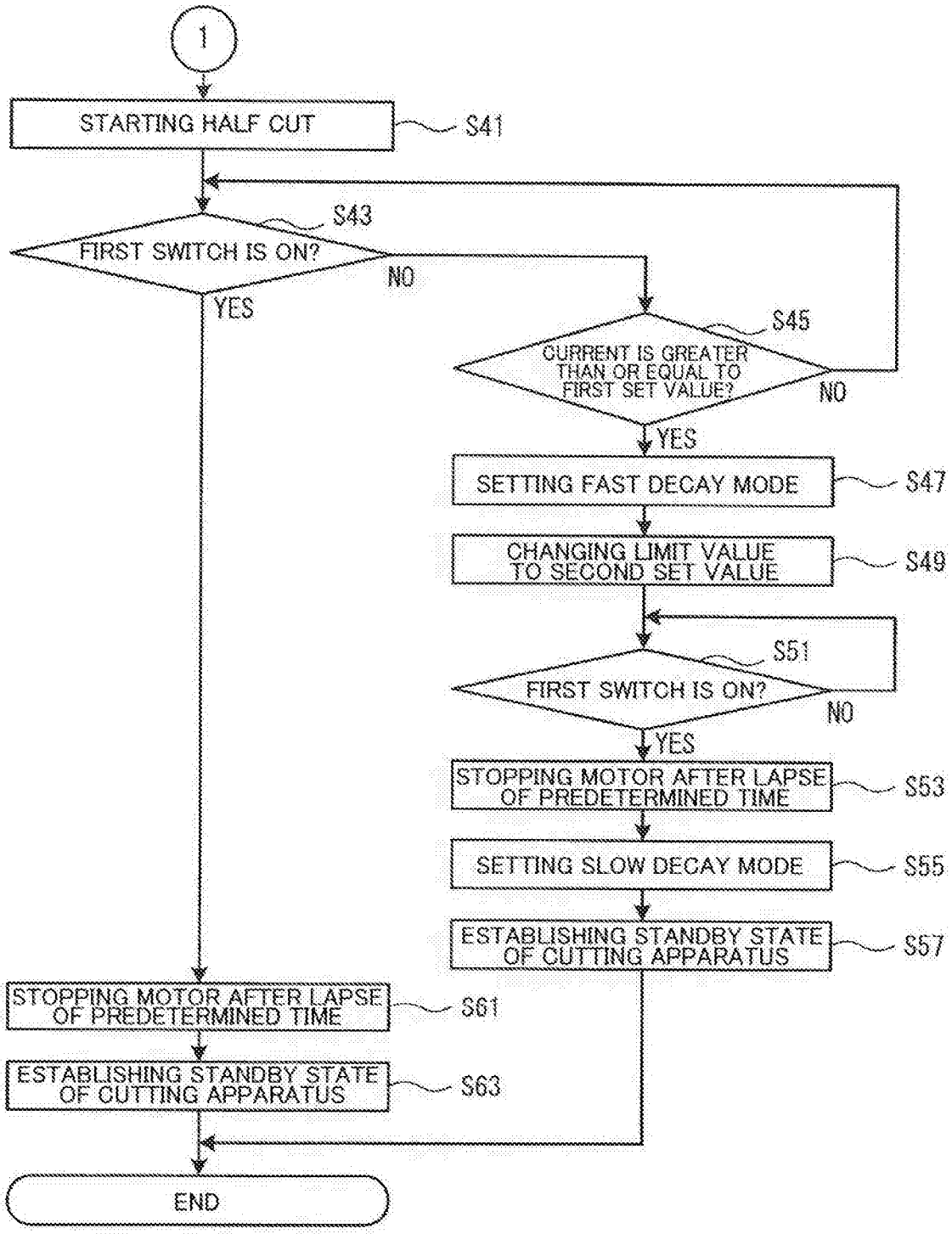
FIG. 14 is a flowchart of the other portion of the main process which is continued from FIG. 13.

There will be next described a main process executed by the ASIC 61 with reference to FIGS. 13 and 14. The main process begins when an operation for performing the half cut is input to the printing apparatus 100. As illustrated in FIG. 13, the ASIC 61 at S11 sets the slow decay mode to the motor driver 62 as the operation mode of the motor 5 to drive the motor 5 in the slow decay mode. The ASIC 61 at S13 sets the cutting apparatus 1 to the standby state by moving the cutter 30 to the wait position and moving the full-cut blade 40 to the separated position. The following is a specific procedure for setting the cutting apparatus 1 to the standby state.

As illustrated in FIG. 9, the signal output from the second switch 57 is switched from the OFF signal to the ON signal at a point in time during movement of the full-cut blade 40 from the separated position to the full-cut position. Thus, in the case where the second switch 57 is outputting the OFF signal at the start of the main process, the ASIC 61 controls the motor driver 62 to start energizing the motor 5 to rotate the motor 5 in the reverse direction. In the case where the signal output from the second switch 57 is switched from the OFF signal to the ON signal, the ASIC 61 controls the motor driver 62 to stop energizing the motor 5. The ASIC 61 then controls the motor driver 62 to start energizing the motor 5 to rotate the motor 5 in the forward direction. In the case where the signal output from the second switch 57 is switched from the ON signal to the OFF signal, the ASIC 61 controlling the motor driver 62 to stop energizing the motor 5 after a lapse of a predetermined length of time.

In the case where the second switch 57 is outputting the ON signal at the start of the main process, the ASIC 61 controls the motor driver 62 to start energizing the motor 5 to rotate the motor 5 in the forward direction. In the case where the signal output from the second switch 57 is switched from the ON signal to the OFF signal, the ASIC 61 stops controlling the motor driver 62 to stop energizing the motor 5 after a lapse of a predetermined length of time.

As a result of these operations, the full-cut blade 40 is positioned at the separated position, and at the same time the cutter 30 is positioned at the wait position, establishing the standby state of the cutting apparatus 1. In this state, the first switch 56 outputs the OFF signal (see FIG. 9).

The ASIC 61 obtains the type of the cassette 104 mounted in the mount portion 8, from the CPU, not illustrated, of the printing apparatus 100, to identify the width of the printing medium 7. The ASIC 61 obtains the number of half cuts stored in the storage 63. The ASIC 61 refers to the table 631 (see FIG. 11) stored in the storage 63 and identifies the first set value corresponding to the identified width of the printing medium 7 and the obtained number of half cuts. The ASIC 61 at S15 sets the identified first set value to the motor driver 62 as the current limit value.

The ASIC 61 at S17 determines whether or not the first set value set to the motor driver 62 at S15 is less than or equal to the threshold value Th. When the ASIC 61 determines that the first set value is less than or equal to the threshold value Th (S17: YES), the ASIC 61 at S19 sets the fast decay mode to the motor driver 62 as the operation mode of the motor 5 such that the motor 5 is to be driven in the fast decay mode.

To start the half cut in the printing medium 7, the ASIC 61 at S21 controls the motor driver 62 to start energizing the motor 5 to start rotating the motor 5 in the forward direction. The cutter 30 starts pivoting from the wait position toward the cutting position. The ASIC 61 at S23 determines whether the first switch 56 detects that the cutter 30 has reached the cutting position, and the signal output from the first switch 56 is switched from the OFF signal to the ON signal.

When the ASIC 61 determines that the signal output from the first switch 56 is switched to the ON signal (S23: YES), the first switch 56 has detected that the cutter 30 has reached the cutting position, and this flow goes to S31. The ASIC 61 at S31 stops controlling the motor driver 62 to stop energizing the motor 5 after a lapse of a predetermined length of time. The driving of the motor 5 is stopped to stop movement of the cutter 30. The half cut in the printing medium 7 is finished. The ASIC 61 adds one to the number of half cuts stored in the storage 63 and updates the number of half cuts.

The ASIC 61 at S33 sets the slow decay mode to the motor driver 62 as the operation mode of the motor 5 to drive the motor 5 in the slow decay mode. Thus, the ASIC 61 changes the operation mode of the motor 5 which is changed at S19, back to the slow decay mode. The ASIC 61 moves the cutter 30 to the wait position and moves the full-cut blade 40 to the separated position in the same manner as that at S13. Thus, the ASIC 61 at S35 sets the cutting apparatus 1 to the standby state, and the main process ends.

When the ASIC 61 determines that the signal output from the first switch 56 is the OFF signal continuously (S23: NO), the first switch 56 has not detected that the cutter 30 has reached the cutting position, and accordingly this flow goes to S25. The ASIC 61 detects the current passed through the motor 5, based on the digital value obtained by the A/D converter 61A. The ASIC 61 at S25 determines whether or not the detected current is greater than or equal to the first set value set to the motor driver 62 at S15. When the ASIC 61 determines that the current passed through the motor 5 is less than the first set value (S25: NO), this flow returns to S23. The ASIC 61 continuously monitors the signal output from the first switch 56.

When the ASIC 61 determines that the current passed through the motor 5 is greater than or equal to the first set value (S25: YES), this flow goes to S27. In this case, there is a high possibility that the cutter 30 has reached the cutting position. The ASIC 61 at S27 sets the second set value to the motor driver 62 as the current limit value to change the maximum value of the current to be passed through the motor 5, from the first set value to the second set value that is less than the first set value. It is noted that the motor driver 62 is set at S19 such that the operation mode of the motor 5 is the fast decay mode. Thus, the motor 5 is driven in the fast decay mode in the case where the current limit value is changed from the first set value to the second set value, and the motor driver 62 drives the motor 5.

The ASIC 61 at S29 determines whether the signal output from the first switch 56 is switched from the OFF signal to the ON signal. When the ASIC 61 determines that the signal output from the first switch 56 is the OFF signal continuously (S29: NO), this flow returns to S29. The ASIC 61 continuously monitors the signal output from the first switch 56. When the ASIC 61 determines that the signal output from the first switch 56 is switched to the ON signal (S29: YES), this flow goes to S31. Explanation of the processings at S31, S33, and S35 is omitted because these processings are the same as in the case where the ASIC 61 at S23 determines that the signal output from the first switch 56 is the ON signal (S23: YES).

When the ASIC 61 determines that the first set value set to the motor driver 62 at S15 is greater than the threshold value Th (S17: NO), this flow goes to S41 (see FIG. 14) without changing the operation mode set for the motor driver 62. In this case, the motor 5 is driven in the slow decay mode (see S11).

As illustrated in FIG. 14, to start the half cut in the printing medium 7, the ASIC 61 at S41 controls the motor driver 62 to start energizing the motor 5 to start rotating the motor 5 in the forward direction. The cutter 30 starts pivoting from the wait position toward the cutting position. The first switch 56 detects that the cutter 30 has reached the cutting position, and the ASIC 61 at S43 determines whether the signal output from the first switch 56 is switched from the OFF signal to the ON signal.

When the ASIC 61 determines that the signal output from the first switch 56 is switched to the ON signal (S43: YES), the first switch 56 has detected that the cutter 30 has reached the cutting position, and this flow goes to S61. The ASIC 61 at S61 stops controlling the motor driver 62 to stop energizing the motor 5 after a lapse of a predetermined length of time. The driving of the motor 5 is stopped to stop movement of the cutter 30. The half cut in the printing medium 7 is finished. The ASIC 61 adds one to the number of half cuts stored in the storage 63 and updates the number of half cuts. The ASIC 61 moves the cutter 30 to the wait position and moves the full-cut blade 40 to the separated position in the same manner as that at S13 (see FIG. 13). Thus, the ASIC 61 at S63 sets the cutting apparatus 1 to the standby state, and the main process ends.

When the ASIC 61 determines that the signal output from the first switch 56 is the OFF signal continuously (S43: NO), the first switch 56 has not detected that the cutter 30 has reached the cutting position, and accordingly this flow goes to S45. The ASIC 61 detects the current passed through the motor 5, based on the digital value obtained by the A/D converter 61A. The ASIC 61 at S45 determines whether or not the detected current is greater than or equal to the first set value set to the motor driver 62 at S15. When the ASIC 61 determines that the current passed through the motor 5 is less than the first set value (S45: NO), this flow returns to S43. The ASIC 61 continuously monitors the signal output from the first switch 56.

When the ASIC 61 determines that the current passed through the motor 5 is greater than or equal to the first set value (S45: YES), this flow goes to S47. In this case, there is a high possibility that the cutter 30 has reached the cutting position. The ASIC 61 at S47 sets the fast decay mode to the motor driver 62 as the operation mode of the motor 5 such that the motor 5 is to be driven in the fast decay mode. The ASIC 61 at S49 sets the second set value to the motor driver 62 as the current limit value to change the maximum value of the current to be passed through the motor 5, from the first set value to the second set value that is less than the first set value. It is noted that the motor driver 62 is set at S47 such that the operation mode of the motor 5 is the fast decay mode. Thus, the motor 5 is driven in the fast decay mode in the case where the current limit value is changed from the first set value to the second set value, and the motor driver 62 drives the motor 5. The current passing through the motor 5 is changed to a value that is less than or equal to the second set value less than the first set value.

The ASIC 61 at S51 determines whether the signal output from the first switch 56 is switched from the OFF signal to the ON signal. When the ASIC 61 determines that the signal output from the first switch 56 is the OFF signal continuously (S51: NO), this flow returns to S51. The ASIC 61 continuously monitors the signal output from the first switch 56. When the ASIC 61 determines that the signal output from the first switch 56 is switched to the ON signal (S51: YES), this flow goes to S53.

The ASIC 61 at S53 stops controlling the motor driver 62 to stop energizing the motor 5 after a lapse of a predetermined length of time. The driving of the motor 5 is stopped to stop movement of the cutter 30. The half cut in the printing medium 7 is finished. The ASIC 61 adds one to the number of half cuts stored in the storage 63 and updates the number of half cuts. The ASIC 61 at S55 sets the slow decay mode to the motor driver 62 as the operation mode of the motor 5 to drive the motor 5 in the slow decay mode. Thus, the ASIC 61 changes the operation mode of the motor 5 which is changed at S47, back to the slow decay mode. The ASIC 61 moves the cutter 30 to the wait position and moves the full-cut blade 40 to the separated position in the same manner as that at S13 (see FIG. 13). Thus, the ASIC 61 at S63 sets the cutting apparatus 1 to the standby state, and the main process ends.

Effects in Present Embodiment

The cutting apparatus 1 stops the pivotal movement of the cutter 30 (S31, S61) in the case where the first switch 56 has detected that the cutting position has reached the cutter (S23: YES, S43: YES) after the cutter 30 starts pivoting from the wait position to the cutting position (S21, S41). As a result, the half cut in the printing medium 7 is finished. Here, due to the error in detection of the first switch 56, the error in dimension of any of the cutter 30 and the receiving stage 73, and the error in assembly of the components, the cutter 30 in some cases reaches the cutting position before the first switch 56 detects that the cutter 30 has reached the cutting position (arrow Y12 in FIG. 10A). In this case, the contact portion 31 of the cutter 30 is pressed against the receiving stage 73 by a large force, leading to a possibility of lower durability due to load imposed on the cutter 30, the receiving stage 73, and the motor 5. It is noted that further pivotal movement of the cutter 30 is prevented in the state in which the contact portion 31 of the cutter 30 is in contact with the receiving stage 73, and accordingly the current passing through the motor 5 increases.

In the cutting apparatus 1, even in the case where the first switch 56 does not detect that the cutter 30 has reached the cutting position (S23: NO, S43: NO), when the current passed through the motor 5 which is detected via the A/D converter 61A is greater than or equal to the first set value (S25: YES, S45: YES), in other words, when the current passed through the motor 5 has reached the first set value, the current passing through the motor 5 is reduced from the first set value to the second set value (S27, S49). This configuration prevents the contact portion 31 of the cutter 30 from being pressed against the receiving stage 73 by a large force. Accordingly, the cutting apparatus 1 can maintain good durability of the cutter 30, the receiving stage 73, and the motor 5.

In the cutting apparatus 1, load on the cutter 30 which is required for performing the half cut in the printing medium 7 changes in accordance with the width of the printing medium 7. Also, the sharpness of the cutting blade 3 decreases due to wear with increase in the number of cuts of the printing medium 7 by the cutter 30. Accordingly, the load on the cutter 30 which is required for performing the half cut in the printing medium 7 also changes. To address these changes, the cutting apparatus 1 sets the first set value based on the width of the printing medium 7 and the number of half cuts in the printing medium 7 by the cutter 30 (S15). This configuration enables the cutting apparatus 1 to change the load on the cutter 30 by setting the first set value, making it possible to perform the half cut in the medium under an appropriate load related to the type of the printing medium 7 and the number of cuts.

In the case where the motor driver 62 drives the motor 5 in the slow decay mode, when the first set value set as the current limit value becomes less than the threshold value Th, there is a possibility that it is impossible to reduce the current to be passed through the motor 5 to a set value (see FIG. 12). To address this situation, the cutting apparatus 1 drives the motor 5 in the fast decay mode (S19) in the case where the first set value is less than or equal to the threshold value Th (S17: YES). This configuration enables the cutting apparatus 1 to pass the current of the desired first set value through the motor 5 to cause pivotal movement of the cutter 30, making it possible to perform the half cut in the printing medium 7. In the case where the current limit value set for the motor driver 62 is changed from the first set value to the second set value at S27 or S49, there is a high possibility that the second set value becomes less than or equal to the threshold value Th, and it is impossible to reduce the current to be passed through the motor 5 to a set value, because the second set value is less than the first set value. To address this situation, in the case where the current passing through the motor 5 is changed to the second set value (S27, S49), the cutting apparatus 1 drives the motor 5 in the fast decay mode (S19, S47). This configuration enables the cutting apparatus 1 to pass the current of the desired second set value through the motor 5 to cause pivotal movement of the cutter 30, making it possible to perform the half cut in the printing medium 7.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure. While the main process is executed in performance of the half cut, a similar process may be executed in performance of the full cut. The cutting apparatus 1 may include only the first switch 56 without including the second switch 57. In this case, the processing for setting the cutting apparatus 1 to the standby state may be executed without using the second switch 57. For example, the cutting apparatus 1 may be configured such that an encoder provided on the motor 5 can identify the rotational position of the motor 5 to set the cutting apparatus 1 to the standby state.

The ASIC 61 identifies the voltage generated between both ends of the resistor R based on the digital value obtained by the A/D converter 61A to detect the current passed through the motor 5, based on the relationship between the identified voltage and the resistor R. The ASIC 61 may detect the current passed through the motor 5 in a different method. For example, a current detecting circuit may be inserted in a signal line between the motor driver 62 and the motor 5. The ASIC 61 may obtain the current detected by the current detecting circuit to detect the current passed through the motor 5.

The cutting apparatus 1 may use a device different from the switch 58 to detect that the cutter 30 has reached the cutting position. For example, the cutting apparatus 1 may include a sensor capable of detecting a position of the cutting blade 3 in the state in which the cutter 30 has reached the cutting position. The cutting apparatus 1 may determine that the cutter 30 has reached the cutting position, when this sensor has detected the cutting blade 3. This sensor may be a contact sensor as in the present embodiment or a non-contact sensor.

The control board 60 on which the ASIC 61, the motor driver 62, and so on are mounted may be incorporated into the cutting apparatus 1 and may be contained in the main casing 2 of the printing apparatus 100.

In the table 631, the first set value may be associated with only one of the width of the printing medium 7 and the number of half cuts. Based on the table 631, the cutting apparatus 1 may determine the first set value based on only one of the width of the printing medium 7 and the number of half cuts. In the table 631, the first set value may be stored in association with the types of the printing medium 7 such as the material, the thickness, and the presence or absence of a substrate. Based on the table 631, the cutting apparatus 1 may determine the first set value based on the various types of the printing medium 7.

The cutting apparatus 1 may cause the cutter 30 to pivot based on an actuator different from the motor 5. For example, the cutting apparatus 1 may cause the cutter 30 to pivot using a solenoid, a power-driven cylinder, a linear motor, or the like to perform the half cut in the printing medium 7. The cutting apparatus 1 may fix the operation mode of the motor 5 to any of the slow decay mode and the fast decay mode, regardless of the magnitude of the first set value and whether the current limit value is changed from the first set value to the second set value.

The cutting apparatus 1 may be used in a state in which the cutting apparatus 1 is incorporated in an apparatus or a device different from the printing apparatus 100. In this case, the medium to be cut is not limited to the printing medium 7 and may be any of various media used in other apparatuses or devices.

The motor driver 62 may not have a function of setting the current limit value. The current passed through the motor 5 by the motor driver 62 may be directly monitored by the ASIC 61.

The printing medium 7 is one example of a medium. The motor 5 is one example of an actuator. The ASIC 61 is one example of a controller. The first switch 56 is one example of a position detector. The A/D converter 61A is one example of a current detector. Each of the processings at S21 and S41 is one example of a first control processing. Each of the processings at S23 and S43 is one example of a first determination processing. Each of the processings at S25 and S45 is one example of a second determination processing. Each of the processings at S27 and S47 is one example of a change processing. Each of the processings at S31 and S61 is one example of a second control processing. The motor driver 62 is one example of a driver. The thermal head 9 is one example of a printing device.

What is claim is:

1. A cutting apparatus, comprising:

a receiving stage configured to support a medium in cutting of the medium;

a cutter comprising: a cutting blade configured to cut the medium in a state in which the medium is located between the cutting blade and the receiving stage; and a contact portion configured to contact the receiving stage, the cutter being movable to (i) a wait position at which the contact portion is spaced apart from the receiving stage and (ii) a cutting position which is nearer to the receiving stage than the wait position and at which the receiving stage and the contact portion are in contact with each other;

an actuator configured to be driven by energization and configured to move the cutter relative to the receiving stage between the wait position and the cutting position;

a controller configured to control the actuator;

a current detector configured to detect a current passed through the actuator; and a position detector configured to detect that the cutter has reached the cutting position, wherein the controller is configured to execute:

a first control processing in which the controller starts the energization of the actuator to move the cutter relative to the receiving stage from the wait position toward the cutting position;

a first determination processing in which the controller determines whether the position detector has detected that the cutter has reached the cutting position in a process in which the cutter is moved relative to the receiving stage from the wait position toward the cutting position;

a second determination processing in which, when the controller determines in the first determination processing that the position detector does not detect that the cutter has reached the cutting position, the controller determines whether a value of the current detected by the current detector has reached a first set value;

a change processing in which, when the controller determines in the second determination processing that the value of the current detected by the current detector has reached the first set value, the controller changes a current to be passed through the actuator to a second set value that is less than the first set value; and a second control processing in which, when the controller determines in the first determination processing that the position detector has detected that the cutter has reached the cutting position, the controller finishes the energization of the actuator and stops movement of the cutter relative to the receiving stage.

2. The cutting apparatus according to claim 1, wherein the controller is configured to:

determine the first set value based on at least one of a type of the medium and the number of cuts of the medium by the cutter; and determine in the second determination processing whether the value of the current detected by the current detector has reached the determined first set value.

3. The cutting apparatus according to claim 1, wherein the actuator is a motor, wherein the cutting apparatus further comprises a driver configured to drive the motor based on a control of the controller and configured to drive the motor in any of a fast decay mode and a slow decay mode, and wherein the controller is configured to:

when the first set value is greater than a particular threshold value, control the driver to drive the motor in the slow decay mode; and when the first set value is less than or equal to the particular threshold value, control the driver to drive the motor in the fast decay mode.

4. The cutting apparatus according to claim 3, wherein the controller is configured to, when the current to be passed through the motor is changed to the second set value in the change processing, control the driver to drive the motor in the fast decay mode.

5. A printing apparatus comprising:

a cutting apparatus comprising (i) a receiving stage configured to support a medium in cutting of the medium, (ii) a cutter comprising (a) a cutting blade configured to cut the medium in a state in which the medium is located between the cutting blade and the receiving stage and (b) a contact portion configured to contact the receiving stage, the cutter being movable to a wait position at which the contact portion is spaced apart from the receiving stage and a cutting position which is nearer to the receiving stage than the wait position and at which the receiving stage and the contact portion are in contact with each other, (iii) an actuator configured to be driven by energization and configured to move the cutter relative to the receiving stage between the wait position and the cutting position, (iv) a controller configured to control the actuator, (v) a current detector configured to detect a current passed through the actuator, and (vi) a position detector configured to detect that the cutter has reached the cutting position, wherein the controller is configured to execute: a first control processing in which the controller starts the energization of the actuator to move the cutter relative to the receiving stage from the wait position toward the cutting position; a first determination processing in which the controller determines whether the position detector has detected that the cutter has reached the cutting position in a process in which the cutter is moved relative to the receiving stage from the wait position toward the cutting position; a second determination processing in which, when the controller determines in the first determination processing that the position detector does not detect that the cutter has reached the cutting position, the controller determines whether a value of the current detected by the current detector has reached a first set value; a change processing in which, when the controller determines in the second determination processing that the value of the current detected by the current detector has reached the first set value, the controller changes a current to be passed through the actuator to a second set value that is less than the first set value; and a second control processing in which, when the controller determines in the first determination processing that the position detector has detected that the cutter has reached the cutting position, the controller finishes the energization of the actuator and stops movement of the cutter relative to the receiving stage; and a printing device configured to perform printing on the medium.

* * * * *